US009739527B2

(12) United States Patent
Kim et al.

(10) Patent No.: US 9,739,527 B2
(45) Date of Patent: Aug. 22, 2017

(54) REFRIGERATOR DOOR

(71) Applicant: LG Electronics Inc., Seoul (KR)

(72) Inventors: Hyunki Kim, Seoul (KR); Minchul Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/060,974

(22) Filed: Mar. 4, 2016

(65) Prior Publication Data

US 2016/0327332 A1 Nov. 10, 2016

(30) Foreign Application Priority Data

May 7, 2015 (KR) ..... 10-2015-0063758

(51) Int. Cl.
*F25D 29/00* (2006.01)
*F25D 23/02* (2006.01)

(52) U.S. Cl.
CPC ..... *F25D 29/005* (2013.01); *F25D 23/02* (2013.01); *F25D 23/028* (2013.01); *F25D 2400/361* (2013.01)

(58) Field of Classification Search
CPC ..... F25D 29/005; F25D 23/02; F25D 23/028; F25D 2400/361
See application file for complete search history.

(56) References Cited

U.S. PATENT DOCUMENTS 5,973,420 A 10/1999 Kaiserman et al.
6,265,682 B1 7/2001 Lee
2003/0043449 A1 3/2003 Takeuchi et al.
2008/0202912 A1 8/2008 Boddie et al.
2009/0107829 A1 4/2009 Heimann
2010/0216929 A1 8/2010 Jung et al.
(Continued)

FOREIGN PATENT DOCUMENTS

CN 101741371 6/2010
DE 29722565 2/1998
(Continued)

OTHER PUBLICATIONS

Office Action issued in Australian Application No. 2016201233 on Aug. 22, 2016, 3 pages.
(Continued)

*Primary Examiner* — Liliana Cerullo
(74) *Attorney, Agent, or Firm* — Fish & Richardson P.C.

(57) ABSTRACT

A refrigerator door may include a front panel that defines a front exterior of the refrigerator door, a door liner coupled to the front panel, an insulating material configured to fill an insulation space defined between the front panel and the door liner, a touch sensor assembly that is configured to press against a rear surface of the front panel, a display assembly that is configured to display an operation state of the refrigerator on the front panel, and that is configured to be inserted into a space between the front panel and the door liner through the insulation space, a sensor connector located at the touch sensor assembly, and a display connector located at the display assembly, and is configured to connect electrically to the sensor connector based on the display assembly being inserted into the space between the front panel and the door liner at an installation position.

9 Claims, 24 Drawing Sheets

(56) References Cited

U.S. PATENT DOCUMENTS

| | | | | |
|---|---|---|---|---|
| 2010/0219176 | A1 | 9/2010 | Striegler | |
| 2011/0048047 | A1* | 3/2011 | Kim | F25D 29/005 62/246 |
| 2011/0134627 | A1 | 6/2011 | Hamlin et al. | |
| 2011/0175845 | A1 | 7/2011 | Honda et al. | |
| 2011/0242028 | A1* | 10/2011 | Lee | G06F 3/0418 345/173 |
| 2011/0299129 | A1 | 12/2011 | Ishida et al. | |
| 2013/0229359 | A1* | 9/2013 | Wang | G06F 1/1643 345/173 |
| 2014/0184577 | A1 | 7/2014 | Kim et al. | |
| 2014/0300263 | A1* | 10/2014 | Sung | G06F 3/044 312/404 |
| 2016/0003519 | A1 | 1/2016 | Kim et al. | |
| 2017/0089633 | A1 | 3/2017 | Kim et al. | |

FOREIGN PATENT DOCUMENTS

| | | |
|---|---|---|
| DE | 10-2009-001412 | 9/2010 |
| EP | 2789943 | 10/2014 |
| EP | 2975345 | 1/2016 |
| EP | 3007361 | 4/2016 |
| JP | 06-095803 | 4/1994 |
| JP | 2006-250485 | 9/2006 |
| JP | 2010230226 | 10/2010 |
| JP | 2013-072581 | 4/2013 |
| JP | 2013-530398 | 7/2013 |
| JP | 2013-181734 | 9/2013 |
| JP | 2014-031978 | 2/2014 |
| JP | 2014-040939 | 3/2014 |
| JP | 2014-137147 | 7/2014 |
| KR | 10-2000-0031593 | 6/2000 |
| KR | 10-0578400 | 5/2006 |
| KR | 10-0663866 | 1/2007 |
| KR | 10-0866342 | 10/2008 |
| KR | 10-2009-0090518 | 8/2009 |
| KR | 10-2010-0050190 | 5/2010 |
| KR | 10-2011-0009438 | 1/2011 |
| KR | 10-2010-0095274 | 3/2012 |
| KR | 10-1132463 | 3/2012 |
| KR | 10-2012-0050070 | 5/2012 |
| KR | 10-1237564 | 2/2013 |
| KR | 10-2013-0040058 | 4/2013 |
| KR | 10-2014-0121753 | 10/2014 |
| WO | 2007/105950 | 9/2007 |
| WO | 2008/069352 | 6/2008 |
| WO | 2009/104859 | 8/2009 |
| WO | 2011/081279 | 7/2011 |
| WO | 2014/034434 | 3/2014 |
| WO | 2014/168391 | 10/2014 |
| WO | 2014/208585 | 12/2014 |

OTHER PUBLICATIONS

Extended European Search Report issued in European Application No. 16161569.5 on Sep. 19, 2016, 7 pages.

Notice of Allowance issued in Korean Application No. 10-2014-0189144 on Aug. 31, 2016, 2 pages.

Notice of Allowance issued in Korean Application No. 10-2014-0186531 on Aug. 31, 2016, 2 pages.

Notice of Allowance issued in Korean Application No. 10-2014-0189150 on Sep. 13, 2016, 2 pages.

Korean Notice of Allowance in Application No. 10-2015-0063758, dated Jun. 28, 2016, 2 pages.

Extended European Search Report issued in European Application No. 15201832.1 on May 3, 2016, 7 pages.

Extended European Search Report issued in European Application No. 15191174.0 on May 31, 2016, 8 pages.

U.S. Office Action in U.S. Appl. No. 14/977,623, dated May 19, 2017, 29 pages.

* cited by examiner

REFRIGERATOR DOOR

CROSS-REFERENCE TO RELATED APPLICATION(S)

The present application claims the benefits of priority to Korean Patent Application No. 10-2015-0063758 filed on May 7, 2015, which is herein incorporated by reference in its entirety.

BACKGROUND

A refrigerator is a household appliance that is used to store food at low temperatures. Touch sensor assemblies may be used for household appliances and may include electrostatic capacitance sensors or sensors using a resistance cell, etc. Such sensors are configured to sense a user's touches, and perform a signal processing to operate household appliances.

SUMMARY

According to one aspect, a refrigerator door may include a front panel that defines a front exterior of the refrigerator door, a door liner coupled to the front panel and configured to define a rear exterior of the refrigerator door, an insulating material configured to fill an insulation space defined between the front panel and the door liner, a touch sensor assembly that is configured to press against a rear surface of the front panel, and that is configured to sense a touch input to the front panel, a display assembly that is configured to display an operation state of the refrigerator on the front panel, and that is configured to be inserted into a space between the front panel and the door liner through the insulation space, a sensor connector located at the touch sensor assembly, and a display connector located at the display assembly, and that is configured to connect electrically to the sensor connector based on the display assembly being inserted into the space between the front panel and the door liner at an installation position.

Implementations according to this aspect may include one or more of the following features. For example, the touch sensor assembly may include a touch sensor mounted to a sensor printed circuit board (PCB), where the sensor connector is configured to extend from the sensor PCB. The sensor connector may include a sensor extension portion that is configured to extend from the sensor PCB to a position at which the sensor connector is coupled to the display connector, and a terminal that is located at an end portion of the sensor extension portion, and that is configured to connect electrically with the display connector. The sensor extension portion may include a part of the sensor PCB. The display assembly may include a light source including a light emitting diode (LED) mounted to a display PCB, an LED controller configured to control the LED, and a sensor controller mounted on the display PCB and configured to process an input to the front panel detected by the touch sensor assembly. The display connector may be provided at a lower side of the display PCB. The display PCB may include a first side surface adjacent to the touch sensor assembly, and a second side surface opposite the first side surface, where the display connector and the sensor connector are provided at a lower end of the second side surface. The front panel may be a metallic front panel. The refrigerator door may include a frame that is configured to press against the rear surface of the front panel and that is configured to define an accommodation space to house the touch sensor assembly and the display assembly. The refrigerator door may include a deco member with an inner side provided with an insertion hole into which the display assembly is configured to be inserted, and that is configured to cover an upper end of the insulation space, and an insertion hole cover configured to cover the insertion hole. The refrigerator door may include a display cover configured to press against the rear surface of the front panel in the accommodation space, where the touch sensor assembly is mounted on the display cover, and a guide rail that is located on the display cover and that is configured to guide an insertion of the display assembly. The refrigerator door may include a display frame that is configured to be inserted into the display cover based on the display assembly being mounted on a front surface of the refrigerator door, and a frame handle that is configured to extend from an upper end of the display frame, where the display frame is configured to be inserted along the guide rail and an upper end of the frame handle is restricted by the insertion hole cover based on the sensor connector being coupled to the display connector.

According to another aspect, a refrigerator may include a storage compartment, and a refrigerator door configured to open and close at least a portion of the storage compartment, the refrigerator door including a front panel that defines a front exterior of the refrigerator door, a door liner coupled to the front panel and configured to define a rear exterior of the refrigerator door, an insulating material configured to fill an insulation space defined between the front panel and the door liner, a touch sensor assembly that is configured to press against a rear surface of the front panel, and that is configured to sense a touch input to the front panel, a display assembly that is configured to display an operation state of the refrigerator on the front panel, and that is configured to be inserted into a space between the front panel and the door liner through the insulation space, a sensor connector located at the touch sensor assembly, and a display connector located at the display assembly, and that is configured to connect electrically to the sensor connector based on the display assembly being inserted into the space between the front panel and the door liner at an installation position.

Implementations according to this aspect may include one or more of the following features. For example, the touch sensor assembly may include a touch sensor mounted to a sensor printed circuit board (PCB), where the sensor connector is configured to extend from the sensor PCB. The sensor connector may include a sensor extension portion that is configured to extend from the sensor PCB to a position at which the sensor connector is coupled to the display connector, and a terminal that is located at an end portion of the sensor extension portion, and that is configured to connect electrically with the display connector. The sensor extension portion may include a part of the sensor PCB. The display assembly may include a light source including a light emitting diode (LED) mounted to a display PCB, an LED controller configured to control the LED, and a sensor controller mounted on the display PCB and configured to process an input to the front panel detected by the touch sensor assembly. The display connector may be provided at a lower side of the display PCB. The display PCB may include a first side surface adjacent to the touch sensor assembly, and a second side surface opposite the first side surface, where the display connector and the sensor connector are provided at a lower end of the second side surface. The front panel may be a metallic front panel.

DETAILED DESCRIPTION

Figure 1:
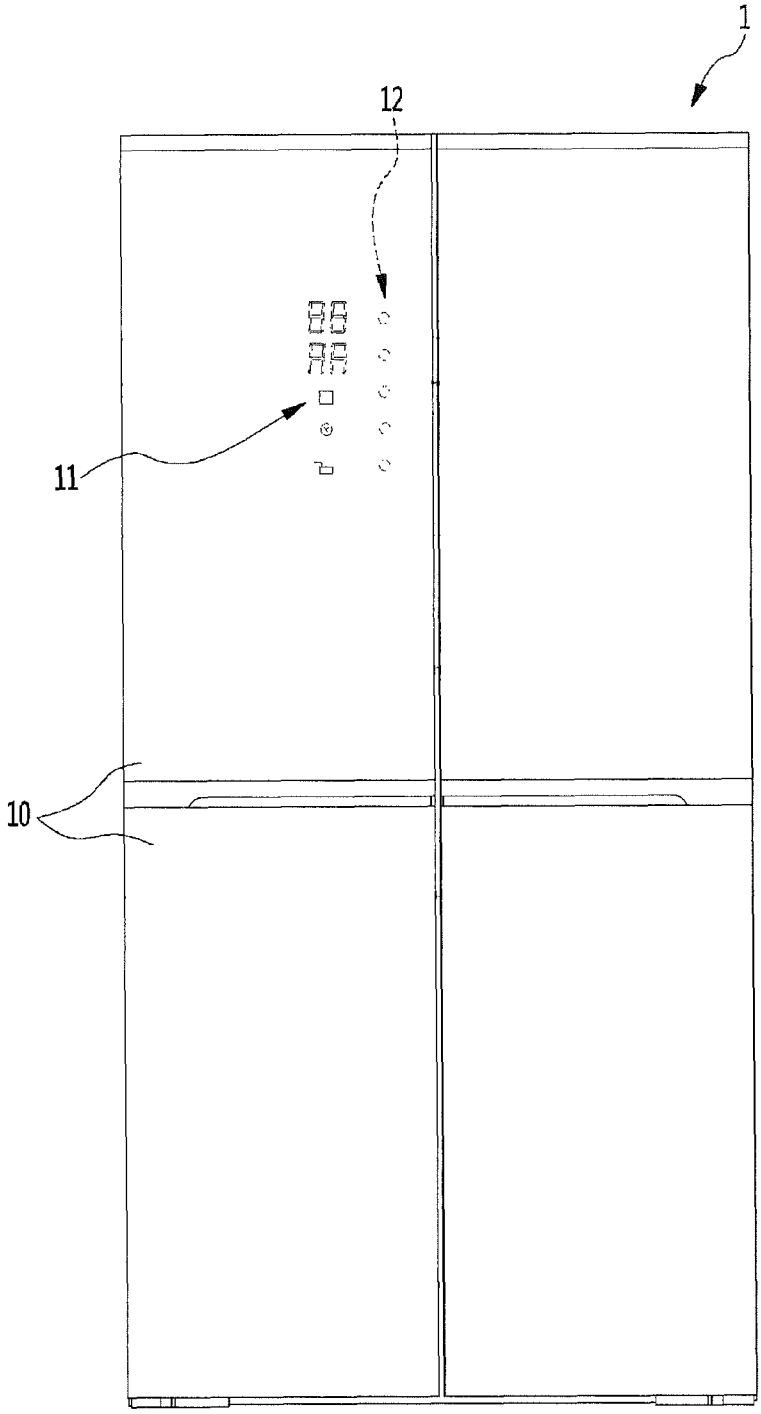
FIG. 1 is a front view illustrating an example of a refrigerator.

As illustrated in FIG. 1, a refrigerator 1 may include cabinets forming storage spaces, and doors 10 which are mounted in the cabinets, and open or close the storage spaces.

The storage spaces may be partitioned horizontally and/or vertically, and a plurality of doors 10 which respectively open or close the storage spaces may be provided at opened front sides of the storage spaces. The doors 10 are configured to open or close the storage spaces using a sliding or pivoting method, and are configured to form a front side exterior of the refrigerator 1 in a state in which the doors are closed.

In addition, a display window 11 and a touch operation unit 12 may be provided on any one door 10 of the plurality of doors 10. Specifically, the display window 11 and the touch operation unit 12 may be provided at a height easy to operate and recognize content shown in the display window 11.

The display window 11 may be used to show operation states of the refrigerator 1 to the outside, displays symbols or numerals when light emitted from an inside of the door 10 transmits toward an outside of the door 10, and enables a user to confirm from the outside.

The touch operation unit 12 may be a portion for a user to perform a touch operation to set an operating condition of the refrigerator 1, and may be provided on a partial region of the front surface of the door 10. In addition, a portion in which a user's push operation is sensed may be formed using a surface processing including a printing or an etching.

Figure 2:
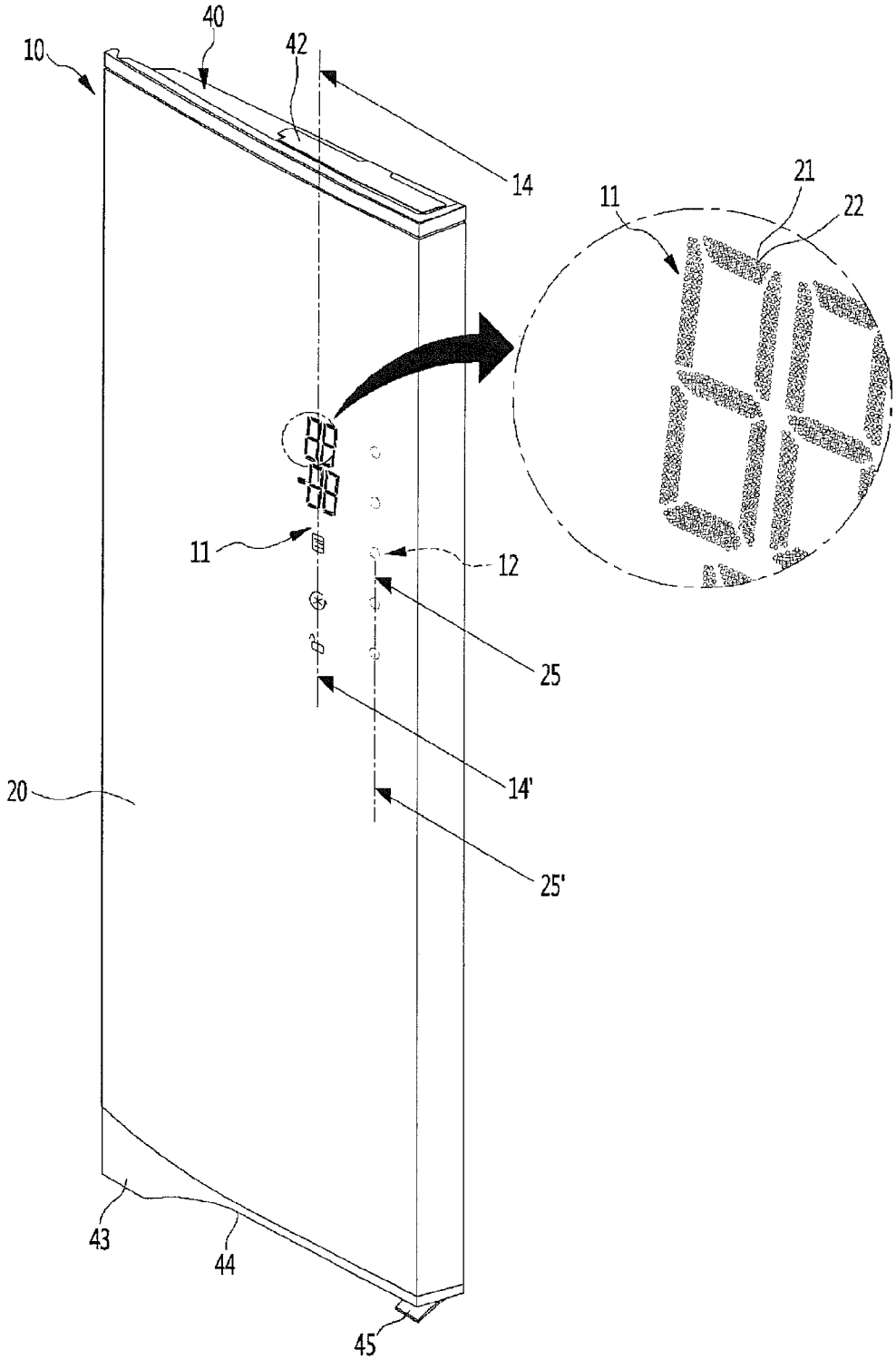
FIG. 2 is a perspective view illustrating an example of a door.
Figure 3:
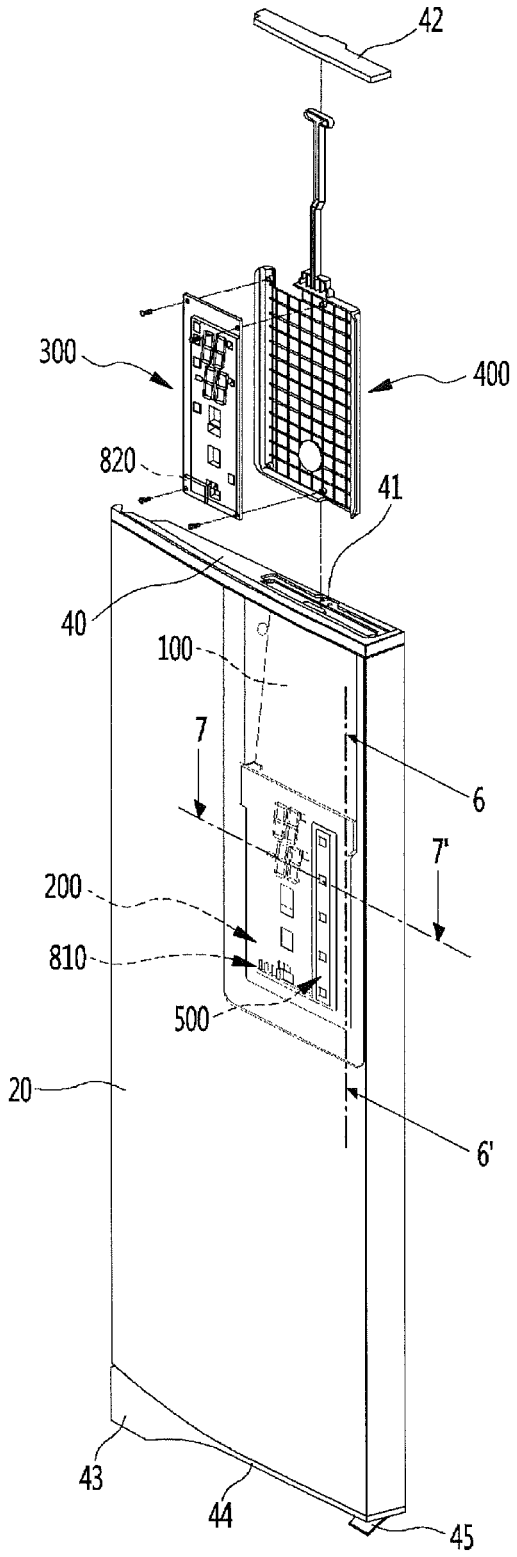
FIG. 3 is an exploded perspective view illustrating a shape in which a display assembly is installed in the door.
Figure 4:
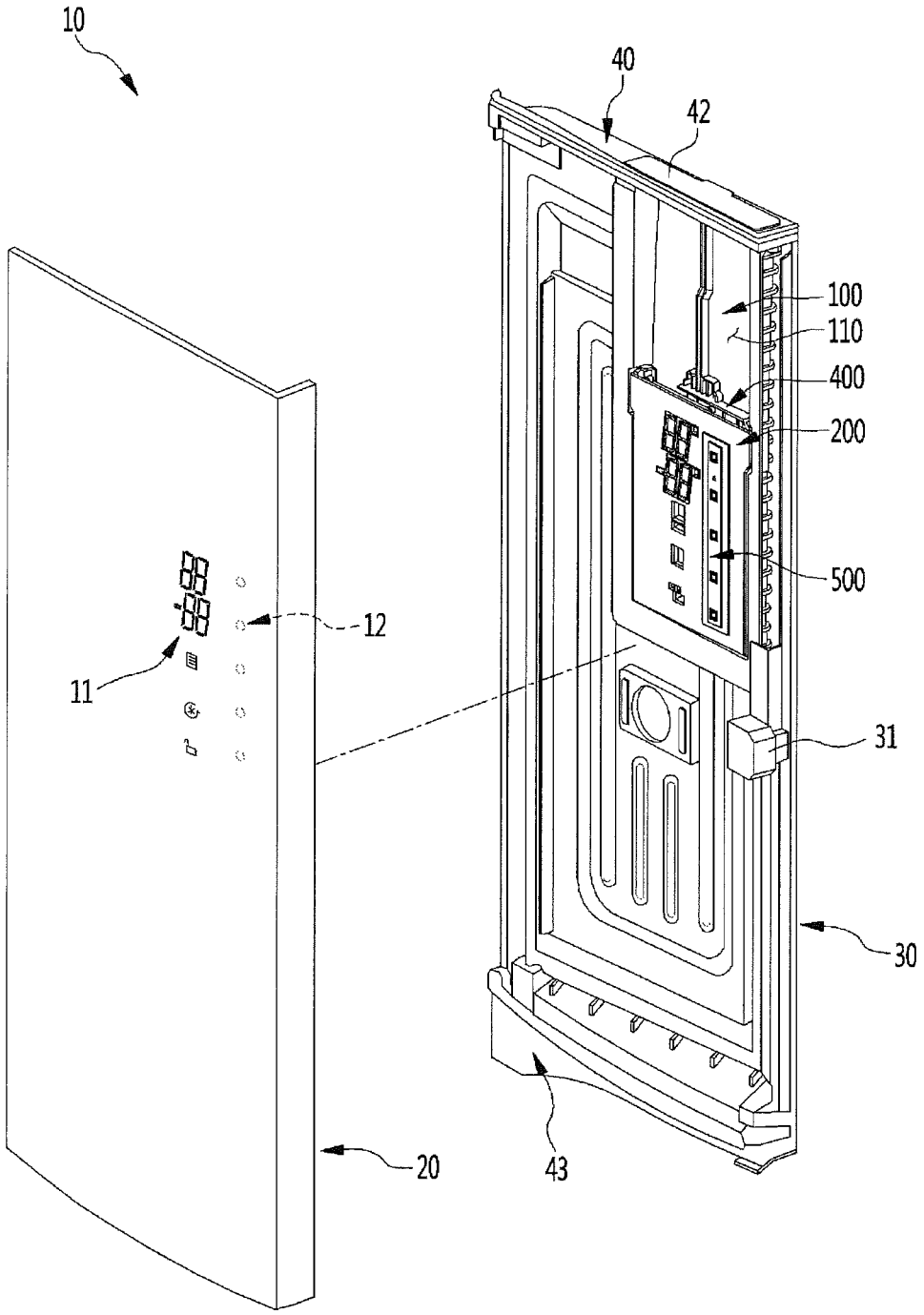
FIG. 4 is an exploded perspective view illustrating a shape in which a front panel of the door is separated.

Referring to FIGS. 2 to 4, the door 10 may include a front panel 20 which defines a front side exterior of the door 10, deco members 40 and 43 may be provided at upper and lower ends of the front panel 20, and a door liner 30 may define a rear side exterior of the door 10.

Specifically, the front panel 20 may be a member which forms the front side exterior of the door 10, and may be formed of a stainless steel having a plate shape. In addition, the front panel 20 may be defined as an exterior member at different household appliances.

In some examples, the front panel 20 may be formed of a stainless steel, a metal, a material having the same feeling as that of a metal, or may be formed of glass or plastic.

The front panel 20 may define the front surface of the door 10, and may also define a part of a side of the door 10, and an anti-fingerprint processing or hairline processing may be further performed at a front surface of the front panel 20.

The display window 11 may be defined by a plurality of first through holes 21 disposed at a partial region of the front panel 20. The display window 11 may be defined as a set of the plurality of first through holes 21 perforated at compact intervals to display numerals or symbols. For example, the set of the plurality of first through holes 21 may be disposed in seven segments (or eighty eight segments) shape, and may also be formed in a specific symbol, image, pattern, or character shape which may show an operating condition or operation state of the refrigerator 1.

Figure 5:
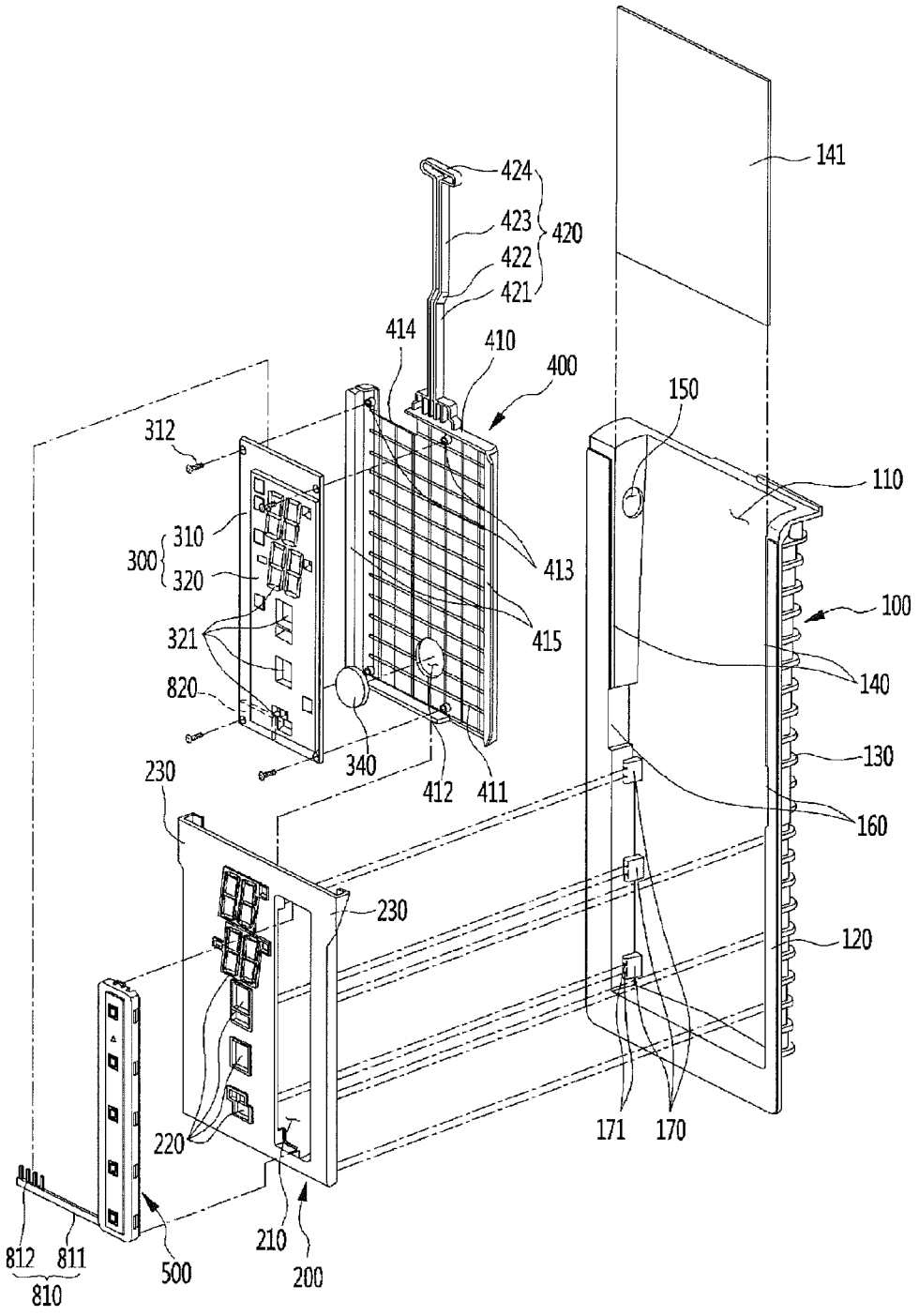
FIG. 5 is an exploded perspective view illustrating a coupling structure of a touch sensor assembly and a display cover, a display assembly, a display frame, and a frame.

The display window 11 is formed at a position corresponding to second through holes 220 and third through holes 321 (see FIG. 5), and is formed so that light emitted from a light-emitting diode (LED) 313 of a display assembly 300 exits to the outside of the door 10. The first through hole 21 may be formed to have a minute size using a laser processing or an etching, and may be formed to have a size which may not be recognized from the outside in a state in which light does not pass therethrough.

Transparent sealing members 22 may be filled inside the first through holes 21. The sealing members 22 prevent the first through holes 21 from being blocked by foreign materials. The sealing members 22 may be formed of a silicone or an epoxy material to fill the first through holes 21, and may be formed of a transparent material so that light passes therethrough. In addition, since the inside of the first through holes 21 are filled with the sealing members 22, there is also an effect that a processed surface of the first through holes 21 may be prevented from being corroded.

The sealing members 22 are filled inside the first through holes 21 through a separated process, the first through holes 21 are filled through a surface coating process of the front panel 20, or a transparent sheet is attached to the front surface the front panel 20, and thus the first through holes may be blocked. For example, an anti-fingerprint coating solution and/or a diffusive sheet provided at the front surface of the front panel 20 may serve as the sealing members 22.

The touch operation unit 12 is a portion marked so that a user touches with fingers, and marks a sensing-possible region in which a touch sensor assembly 500 senses when the user touches the touch operation unit 12. The touch operation unit 12 may be marked at the front surface of the front panel 20 using a surface processing such as an etching, a printing, or other surface processing. In addition, the touch operation unit 12 may be formed in a non-protrusive shape when seen from the outside.

The door liner 30 is coupled to the front panel 20, and faces an inside of the storage space when the door 10 is closed. The door liner 30 may be injection molded from a plastic material, and a gasket may be disposed along the door liner or an installation structure for coupling of a basket or the like may be provided. In addition, when the door liner 30 and the front panel 20 are coupled, a space between the door liner 30 and the front panel 20 may be formed, and may be filled with a foam solution forming a heat insulating material 24.

A frame 100 may be attached to a rear surface of the front panel 20. The frame 100 is provided to form a separate space inside the door 10 in which a foam solution is not filled. The separated space formed by the frame 100 accommodates a display cover 200, the display assembly 300, the touch sensor assembly 500, and a display frame 400.

The deco members 40 and 43 are members which define an upper side and a lower side of the door 10, and cover openings formed at an upper end and a lower end of the front panel 20 and an upper end and an lower end of the door liner 30.

An insertion hole 41 is formed at a deco member 40 of the deco members 40 and 43 which is coupled to the upper end of the door 10, and the insertion hole 41 is covered by a insertion hole cover 42. The insertion hole 41 communicates with the separated space defined by the front panel 20 and the frame 100. In addition, when the door 10 is assembled, in a state of being coupled to the display frame 400, the display assembly 300 may be inserted into the frame 100 through the insertion hole 41 The insertion hole 41 may be formed to have a size through which the display frame 400 can be inserted thereinto, and may be positioned right above the display cover 200.

A hinge hole through which a hinge which is a pivot of the door 10 passes may be formed at an edge of a side of the deco member 40. In addition, wires introduced inside the frame 100 through the hinge hole may extend, power may be supplied to electric components inside the frame 100, and operation signals may be transmitted and received.

A door handle 44 may be provided at the deco member 43 coupled at the lower end of the door 10. The door handle 44 may be formed by a part of the deco member 43 being recessed in a pocket shape, and a user may grip the recessed door handle 44 and pivot the door 10. In addition, a lever 45 may be further provided at the deco member 43 of the lower end of the door 10 to perform open/close operations of the door 10. Specifically, as a latch assembly 31 is driven by operating the lever 45, the door 10 may maintain an opened or a closed state.

The display cover 200 is adhered at the rear surface of the front panel 20. The display cover 200 is configured to guide installation of the display assembly 300 in which an LED 313 (see FIG. 15) is mounted may be adhered at the rear surface of the front panel 20 using an adhesive member 25 formed by being coated with a double-sided tape or a primer.

The touch sensor assembly 500 which senses a user's touch of the front panel 20 may be mounted on a side of the display cover 200. The display cover 200 may be attached to the front panel 20 in a state in which the touch sensor assembly 500 is mounted on the display cover 200.

When the display cover 200 is attached to the rear surface of the front panel 20, the display window 11 formed on the front panel 20 matches the second through holes 220 formed in the display cover 200. In addition, the display cover 200 is accommodated in the frame 100 in a state in which the display cover 200 is attached to the rear surface of the front panel 20.

In addition, in a state in which the display assembly 300 is mounted on the display frame 400, the display assembly 300 may be inserted into an inner space of the frame 100 through the insertion hole 41. A coupled body of the display frame 400 and the display assembly 300 is inserted into an insertion space defined by the display cover 200.

When the display frame 400 is completely inserted into the inside of the frame 100, the display assembly 300 is positioned in the rear of the second through holes 220 of the display cover 200. Accordingly, light emitted from the LED 313 may pass the display cover 200 and the display window 11 and may be emitted toward an outside of the door 10.

Referring to FIGS. 5 to 8, a front side and an upper side of the frame 100 are opened. Accordingly, when the frame 100 is attached to the rear surface of the front panel 20, an opening 110 is formed at the upper side of the frame 100. In addition, a front end portion of the frame 100 is bent in a direction parallel to the front panel 20, and forms a frame adhesive portion 120. Specifically, the frame adhesive portion 120 is a portion which adheres to the rear surface of the front panel 20, and is bent to have a predetermined width in a direction toward an outside of the frame 100. Since an upper end portion of the frame 100 is opened, the frame adhesive portion 120 may be formed in a U shape which connects a left side of a front side portion, a lower side of the front side portion, and a right side of the front side portion of the frame 100.

The adhesive member 25 formed of a double-sided tape or an adhesive may be provided at the frame adhesive portion 120, and the frame 100 may be attached to the rear surface of the front panel 20.

In a state in which the frame 100 is attached to the rear surface of the front panel 20, the upper side of the frame 100 contacts a bottom surface of the deco member 40. The deco member 40 is disposed on the upper side of the frame 100, and the opening 110 of the frame 100 communicates with the insertion hole 41 formed at the deco member 40.

Accordingly, even though a foam solution configured to form the heat insulating material 24 is foamed inside the door 10, the foam solution is not introduced into the inner space of the frame 100. In addition, a plurality of reinforcement ribs 130 may be formed at a rear surface of the frame 100 in a grid shape. Accordingly, even though a high pressure foam solution configured to form the heat insulating material 24 is foamed inside the door 10, a shape of the frame 100 may not be deformed or broken due to the reinforcement rib 130, and the inner space of the frame 100 may be stably maintained.

In addition, a support plate 141 may be seated on an upper region of the front side portion of the frame 100. To this end, plate support portions 140 may be formed at a left edge and a right edge of the front side portion of the frame. The plate support portions 140 may be formed by parts of inner edges of the frame adhesive portion 120 being stepped at a height corresponding to a thickness of the support plate 141.

In a state in which the display cover 200 is accommodated inside the frame 100, the support plate 141 is provided to cover the front side portion of the frame 100 corresponding to an upper side of the display cover 200. In addition, when the support plate 141 is seated on the plate support portions 140, a front surface of the support plate 141, a front surface of the display cover 200, and the frame adhesive portion 120 form the same plane. When the frame 100 is attached to the rear surface of the front panel 20, a phenomenon in which the frame 100 is shaken or is not firmly attached to the front panel 20 may be prevented. In addition, a portion of the front panel 20 in which a height difference is generated is prevented from being deformed by an impact from the outside.

The plate support portions 140 are configured to support left and right end portions of the support plate 141. In addition, in a state in which the frame 100 is attached to the front panel 20, the support plate 141 may slide and be inserted into a space formed between the plate support portion 140 and the rear surface of the front panel 20. In addition, the support plate 141 may also be attached to the rear surface of the front panel 20 with the frame 100 in a state in which the support plate 141 is fixed to the plate support portion 140.

A wire inlet hole 150 may be formed at an upper portion of a side of the frame 100. The wire inlet hole 150 forms a path through which wires which connect electric components provided inside the frame 100 and a power portion of the cabinet pass. As the wire inlet hole 150 is formed at an upper portion of the side thereof adjacent to a hinge of the door 10, a distance between the wire inlet hole 150 and a hinge hole of the door 10 may be minimized. In addition, before the wires are disposed through the wire inlet hole 150 and a foam solution is foamed inside the door 10, a finishing process which covers the wire inlet hole 150 is performed, and thus a foam solution is prevented from being introduced into the frame 100.

Restraint grooves 160 may be respectively formed at left and right sides of the frame 100. The restraint grooves 160 are portions into which restraint portions 230 which protrude in a widthwise direction of the display cover 200 from both side ends of the display cover 200 are respectively inserted. As the restraint groove 160 is formed to be recessed in a shape corresponding to that of the restraint portion 230, the display cover 200 maintains a correct position and is not shaken in a state in which the display cover 200 is accommodated in the frame 100.

Cover support portions 170 which support the display cover 200 may be formed to protrude at side surfaces corresponding to lower sides of the restraint grooves 160 of inner surfaces of the frame 100. The inner space of the frame 100 which corresponds to the lower sides of the restraint grooves 160 is a portion in which the display cover 200 is accommodated. The cover support portions 170 protrude from left and right side surfaces of the frame 100 toward a center of the frame 100, and push and support both side end portions of a rear surface of the display cover 200.

In a state in which the display cover 200 is attached to the rear surface of the front panel 20, when the frame 100 is attached to the front panel 20 and a foam solution is foamed inside the door 10, the cover support portions 170 push forward the display cover 200, and maintain a state in which the display cover 200 is attached to the front panel 20.

Particularly, even though the adhesive member 25 which adheres the display cover 200 to the rear surface of the front panel 20 is hardened and loses a function thereof, a state in which the display cover 200 is pressed against the rear surface of the front panel 20 is maintained by a force that the cover support portions 170 press the display cover 200.

A plurality of cover support portions 170 may be vertically disposed at predetermined intervals, and evenly push and support the entire rear surface of the display cover 200. In addition, one or a plurality of protrusions 171 may be further formed at front surfaces of the cover support portions 170 which contact the rear surface of the display cover 200. The protrusion 171 may be formed in a rib shape formed in a lengthwise direction or in a protrusive shape having a hemisphere shape, and may be in line or point contact with the display cover 200. Accordingly, even though contact surfaces between the display cover 200 and the cover support portions 170 are not even, the display cover 200 is not inclined. In addition, the cover support portions 170 may transmit even pressure to the display cover 200.

For example, in a state in which the display cover 200 is obliquely inclined forward or backward and is pressed against the rear surface of the front panel 20, the frame 100 may be pressed by a foam solution. In this case, while the protrusions 171 which press the surfaces of the display cover 200 corresponding to a side comparatively far away from the front panel 20 are worn down by pressure of the foam solution, the display cover 200 may be aligned at a right position.

The display cover 200 may be formed of a plate-shaped plastic material, and may be accommodated in the frame 100 in a state in which the display cover 200 is attached to the front panel 20.

An accommodation portion 210 at which the touch sensor assembly 500 is installed is formed at the display cover 200. In addition, after assembly, the plurality of second through holes 220 may be formed at the display cover 200 of a position corresponding to the display window 11.

The display assembly 300 may include a display PCB 310 on which the LED 313 is mounted, and a reflector 320 disposed at a front surface of the display PCB 310.

Figure 8:
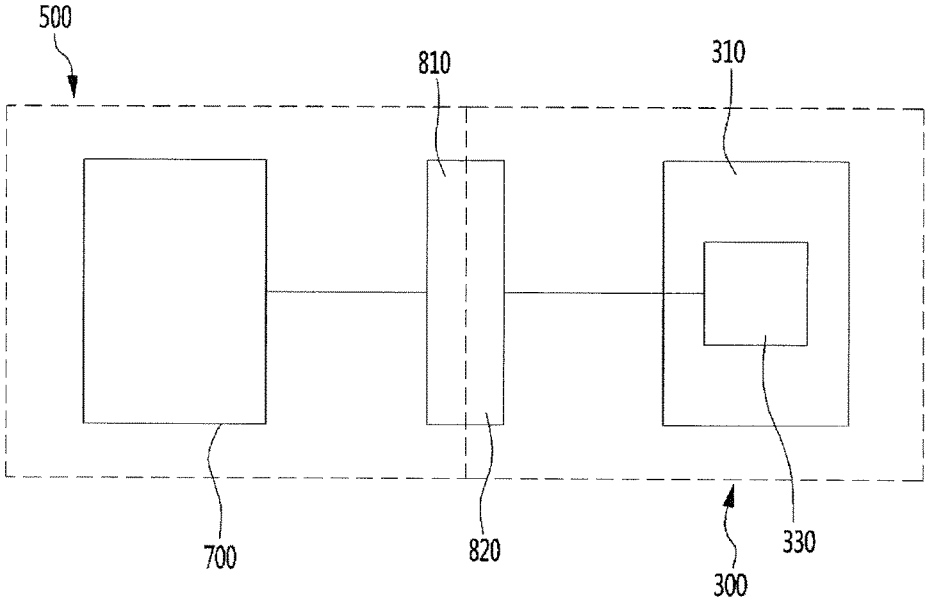
FIG. 8 is a block diagram for showing connection between a sensor printed circuit board (PCB) and a display PCB.

An LED controller configured to drive the LED 313, and a sensor controller 330 configured to drive the touch sensor assembly 500 may be mounted on the display PCB 310. The sensor controller 330 processes touch signals of the front panel 20 sensed through the touch sensor assembly 500 using the display PCB 310. To this end, as illustrated in FIG. 8, a sensor connector 810 may be formed on the sensor PCB 700 of the touch sensor assembly 500, and a display connector 820 may be provided on the display PCB 310. The sensor connector 810 may be provided with a PCB extension portion 811 and a terminal 812 formed at an end portion of the PCB extension portion 811. In addition, when the display assembly 300 is mounted in the display cover 200, the sensor connector 810 and the display connector 820 are connected to each other. That is, since the sensor connector 810 and the display connector 820 are connected to each other by only a process of inserting the display assembly 300 into the insertion hole 41 for assembly, there is an advantage in that the number of processes is decreased. In addition, by connecting the sensor connector 810 to the display connector 820, a touch signal (or an operation signal) generated by touching the touch sensor assembly 500 may be processed.

Meanwhile, as the sensor connector 810 and the display connector 820 are positioned to be as far as possible from positions on which a user directly performs a touch operation, an influence of static electricity generated in use may be minimized.

That is, the possibility in which the static electricity is transmitted to the display PCB 310, and components mounted on the display PCB 310 are electrically damaged is minimized.

In addition, the reflector 320 attached to the front surface of the display PCB 310 guides light emitted by the LED 313 to focus on the first through holes 21. The reflector 320 not only guides the light emitted by the LED 313 but also enables the display PCB 310 and the display terminal 311 to be spaced a distance corresponding to a thickness of the reflector 320 from the rear surface of the front panel 20, and protects the display PCB 310 from static electricity.

Particularly, because of a characteristic of the structure in which the front panel 20 is formed of a stainless steel and the display assembly 300 is disposed to be adjacent to the display window 11, the front panel 20 may be vulnerable to static electricity generated while a user touches the touch operation unit 12. Accordingly, as the reflector 320 is disposed at the front surface of the display PCB 310, the display PCB 310 is structurally spaced apart from the front panel 20, simultaneously, transmission of light is also excellent, and the display PCB 310 is protected from static electricity.

The third through holes 321 which correspond to an arrangement position of the LED 313 and communicate with the second through holes 220 and the first through holes 21 are formed at the reflector 320. In a state in which the display assembly 300 is mounted on the display frame 400, when the display frame 400 is mounted on the display cover 200, the first through holes 21, the second through holes 220, and the third through holes 321 are pressed forward or backward against each other and communicate with each other. The light emitted by the LED 313 passes through the first to the third through holes 21, 220, and 321 and is emitted to the outside of the door 10 through the display window 11.

An audio output unit 340 may be provided at a rear surface of the display PCB 310. The audio output unit 340 may be a unit configured to tell an operation state of the refrigerator 1 using a sound, and may include a speaker, a buzzer, and the like. The audio output unit 340 may be inserted into a frame hole 412 formed in the display frame 400. A sound output from the audio output unit 340 is transmitted to a user located in front of the door 10, and the user may recognize the operation state or a driving state of the refrigerator 1.

The display frame 400 in which the display assembly 300 including the display PCB 310 is installed may be formed in a plate shape so that the display PCB 310 can be seated. A space in which the display PCB 310 is accommodated is defined at a front side of the display frame 400 by an edge 410 which extends along an edge of the display frame 400 and protrudes forward from the display frame 400. A sliding insertion portion 415 may be formed at a front end portion of the edge 410 formed at left and right edges of the display frame 400 in the front end portion of the edge 410. The sliding insertion portion 415 is formed in a shape of rib bent in a direction perpendicular to the edge 410, that is, in a width wise direction of the display frame 400.

When the display frame 400 is coupled to the display cover 200, the sliding insertion portion 415 is inserted into an inside of a guide rail 240 formed at the display cover 200. Accordingly, the display frame 400 may be smoothly mounted on the display cover 200 by the sliding insertion portion 415.

A reinforcement rib 411 which has a grid shape and vertically and horizontally extends at predetermined intervals may be formed at the entire front side of the display frame 400. A frame cut portion 414 may be formed at an upper end of the display frame 400. As the frame cut portion 414 is cut at a position corresponding to the display terminal 311, interference between the display terminal 311 and the display frame 400 may be prevented.

In addition, bosses 413 through which screws 312 configured to fix the display PCB 310 to the display frame 400 are fastened may be protrusively formed at the front side of the display frame 400. Accordingly, in a state in which the display PCB 310 is spaced a distance corresponding to a protrusion height of the bosses 413 from the front side of the display frame 400, the display PCB 310 may be fixed to the display frame 400.

A frame handle 420 is formed to extend upward at a central portion of the upper end of the display frame 400. The frame handle 420 is a portion that a user grips and operates when the display frame 400 is coupled to the display cover 200.

The frame handle 420 includes a first vertical portion 421 which extends from the display frame 400, a inclined portion 422 which extends to be inclined backward from an upper end of the first vertical portion 421, and a second vertical portion 423 which extends upward from an upper end the inclined portion 422.

The first vertical portion 421 and the second vertical portion 423 extend in parallel each other, and connected by the inclined portion 422. In addition, a grip portion 424 that a user grips is formed to extend in a horizontal direction at an upper end of the second vertical portion 423.

The user grips the grip portion 424 and inserts the display frame 400 from the lower end of the display frame 400 into an inside of the insertion hole 41 to insert the display frame 400 into the display cover 200. In addition, as the display frame 400 is more inserted downward thereinto, the display frame 400 may be more easily pressed against the rear surface of the display cover 200 because of a structure of the frame handle 420.

In a state in which the display frame 400 is completely inserted into an inside of the display cover 200, when the insertion hole cover 42 is mounted in the insertion hole 41, a bottom surface of the insertion hole cover 42 contacts a top surface of the grip portion 424. A handle coupling portion formed in a shape corresponding to the grip portion 424 may be formed at the bottom surface of the insertion hole cover 42. When the insertion hole cover 42 is mounted in the insertion hole 41, an upper end of the frame handle 420 may be coupled to the handle coupling portion, and a fixed state thereof may be maintained.

Figure 9:
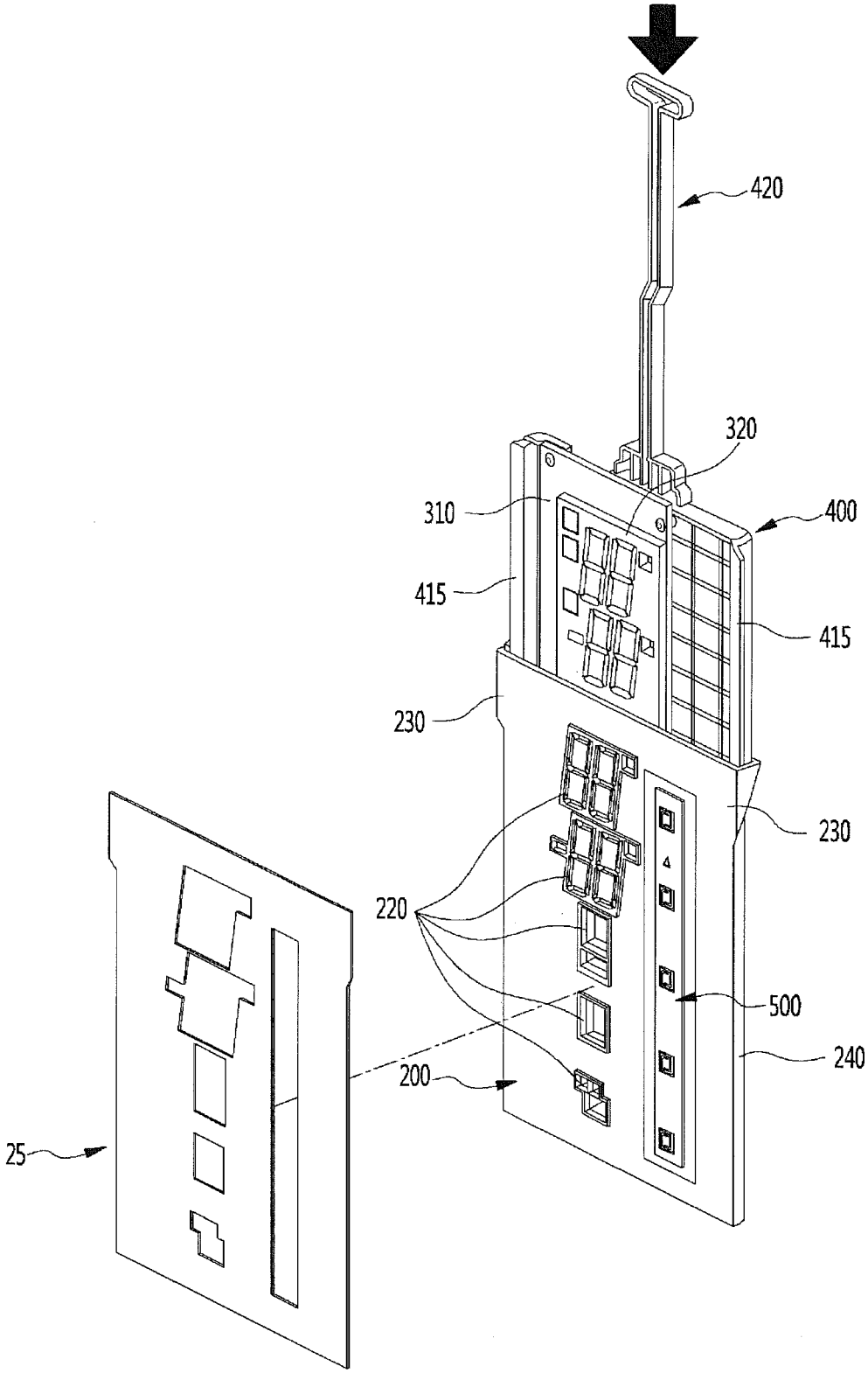
FIG. 9 is a perspective view illustrating a coupling structure of the display cover and the display frame.
Figure 10:
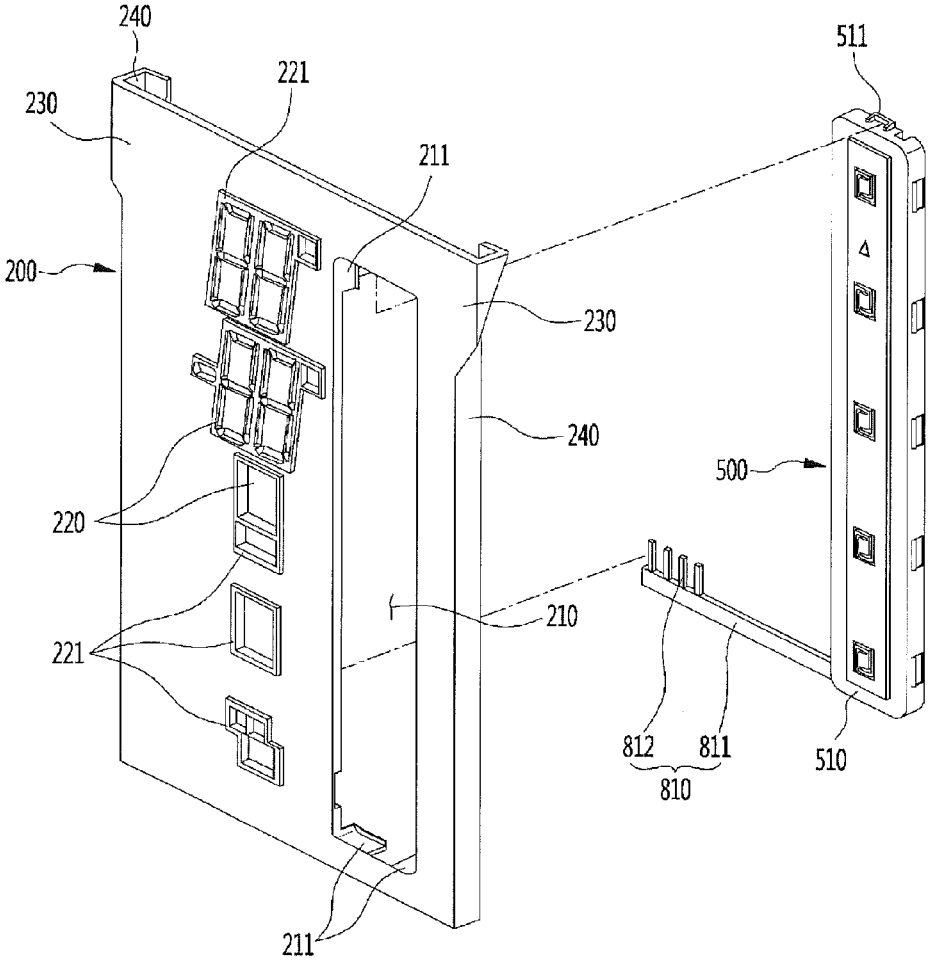
FIG. 10 is an exploded perspective view illustrating a coupling structure of the display cover and the touch sensor assembly.
Figure 11:
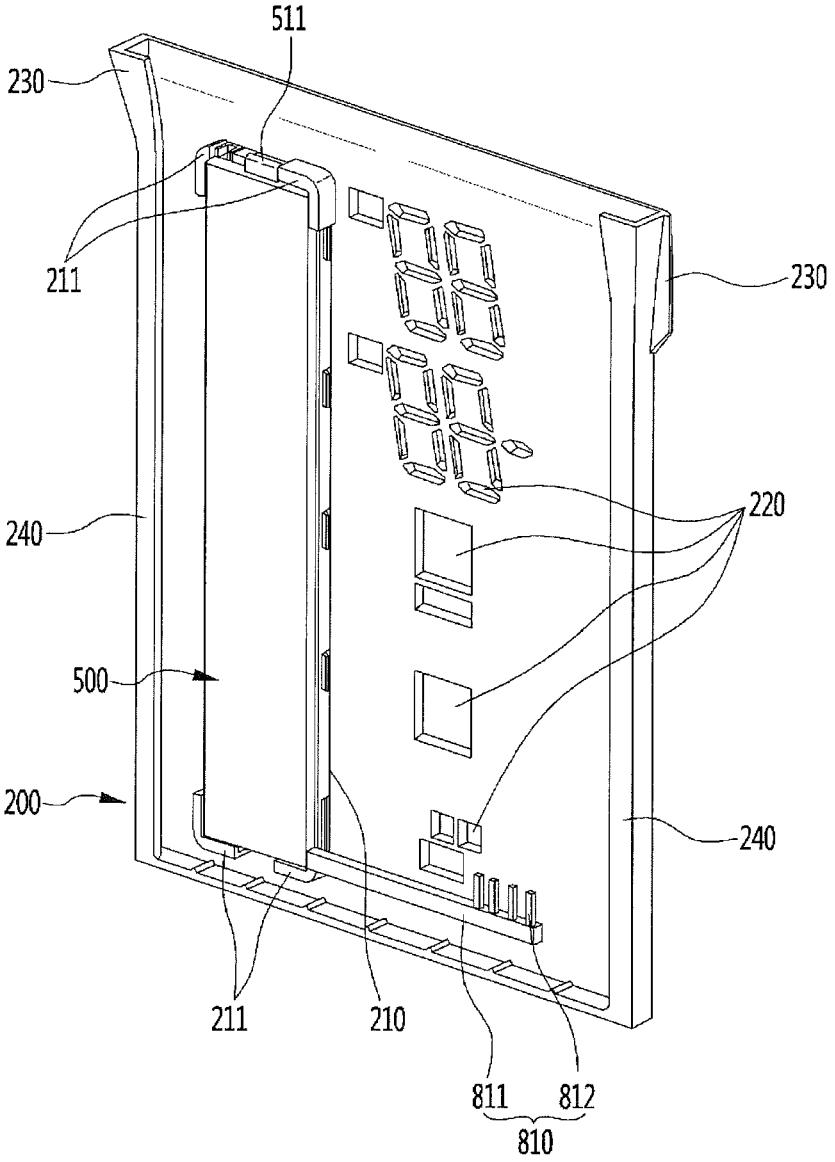
FIG. 11 is a perspective view illustrating the display cover in which the touch sensor assembly is installed, seen from behind.

Referring to FIGS. 9 to 11, the guide rail 240 is formed at left and right side ends of the display cover 200. The guide rail 240 is formed by the both ends of the display cover 200 being bent a plurality of times, and the sliding insertion portion 415 is inserted into the inside of the display cover 200 along the guide rail 240.

Figure 6:
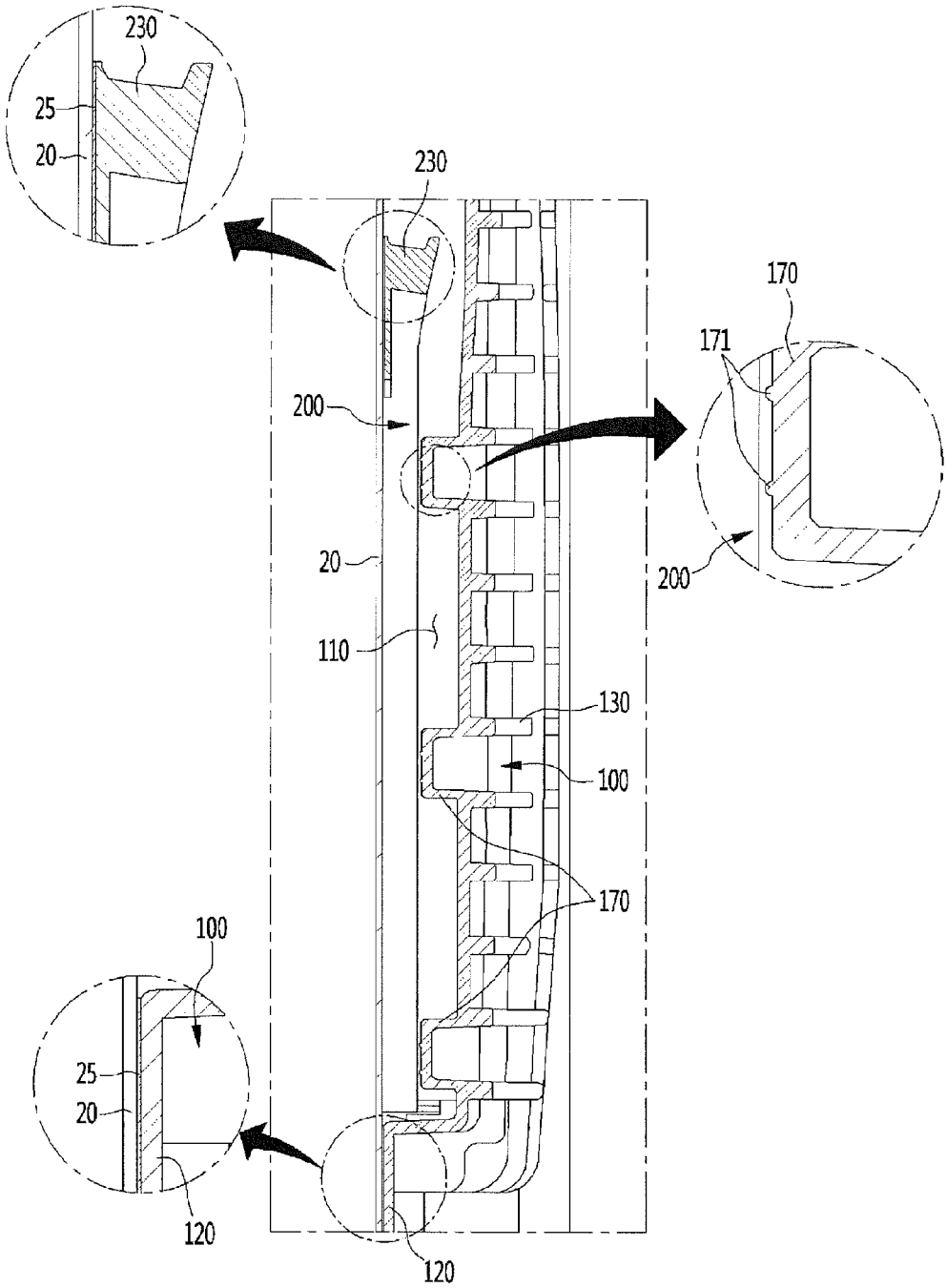
FIG. 6 is a longitudinal sectional view taken along line 6-6' of FIG. 3.
Figure 7:
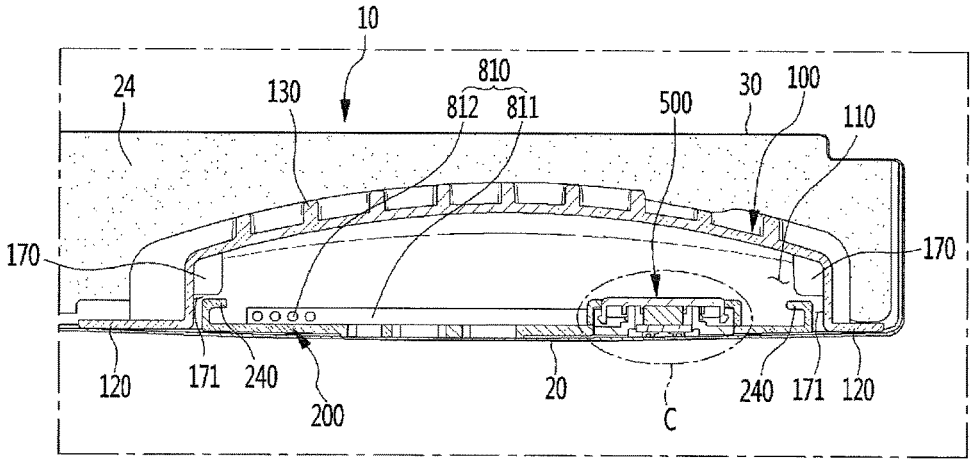
FIG. 7 is a transversal sectional view taken along line 7-7' of FIG. 3.

Here, as illustrated in FIG. 6, as a forward and backward width of an upper end portion of the guide rail 240 is formed greater than a forward and backward width of a lower end portion thereof, the sliding insertion portion 415 may be easily inserted thereinto.

In addition, a rear side of the guide rail 240 is inclined in a direction more adjacent to the front surface of the display cover 200 toward a lower portion thereof. Accordingly, as the display frame 400 is more inserted into the display cover 200, the display assembly 300 mounted on a front surface of the display frame 400 is in more pressed against the display cover 200. In a state in which the display frame 400 is completely inserted into the display cover 200, the sliding insertion portion 415 is fixed to an inside of the guide rail 240 and the reflector 320 is completely pressed against the rear surface of the display cover 200. The third through holes 321 are aligned forward and backward with the second through holes 220.

The front surface of the display cover 200 is attached to the rear surface of the front panel 20, and the accommodation portion 210 which accommodates the touch sensor assembly 500 is formed at a side of the front surface of the display cover 200. The accommodation portion 210 is opened in a shape corresponding to a shape of the touch sensor assembly 500, and the touch sensor assembly 500 is inserted thereinto. In addition, in a state in which the touch sensor assembly 500 is mounted in the accommodation portion 210, a front surface of the touch sensor assembly 500 and the front surface of the display cover 200 form the same plane.

Housing support portions 211 may be formed to extend backward from the display cover 200 at four corners of an opening which defines the accommodation portion 210. The housing support portions 211 extend in a "L" shape from the four corners of the accommodation portion 210. The housing support portions 211 cover and support side corners of the touch sensor assembly 500. In addition, an end portion of the housing support portion 211 may be bent again and pressed against a rear surface of the touch sensor assembly 500. That is, the side corner portions and the rear surface portion of the touch sensor assembly 500 are supported by the housing support portion 211. Accordingly, even though a user touches the front panel 20, and the front surface of the touch sensor assembly 500 is pressed, the touch sensor assembly 500 is not moved backward, and an initially assembled state is maintained.

Figure 16:
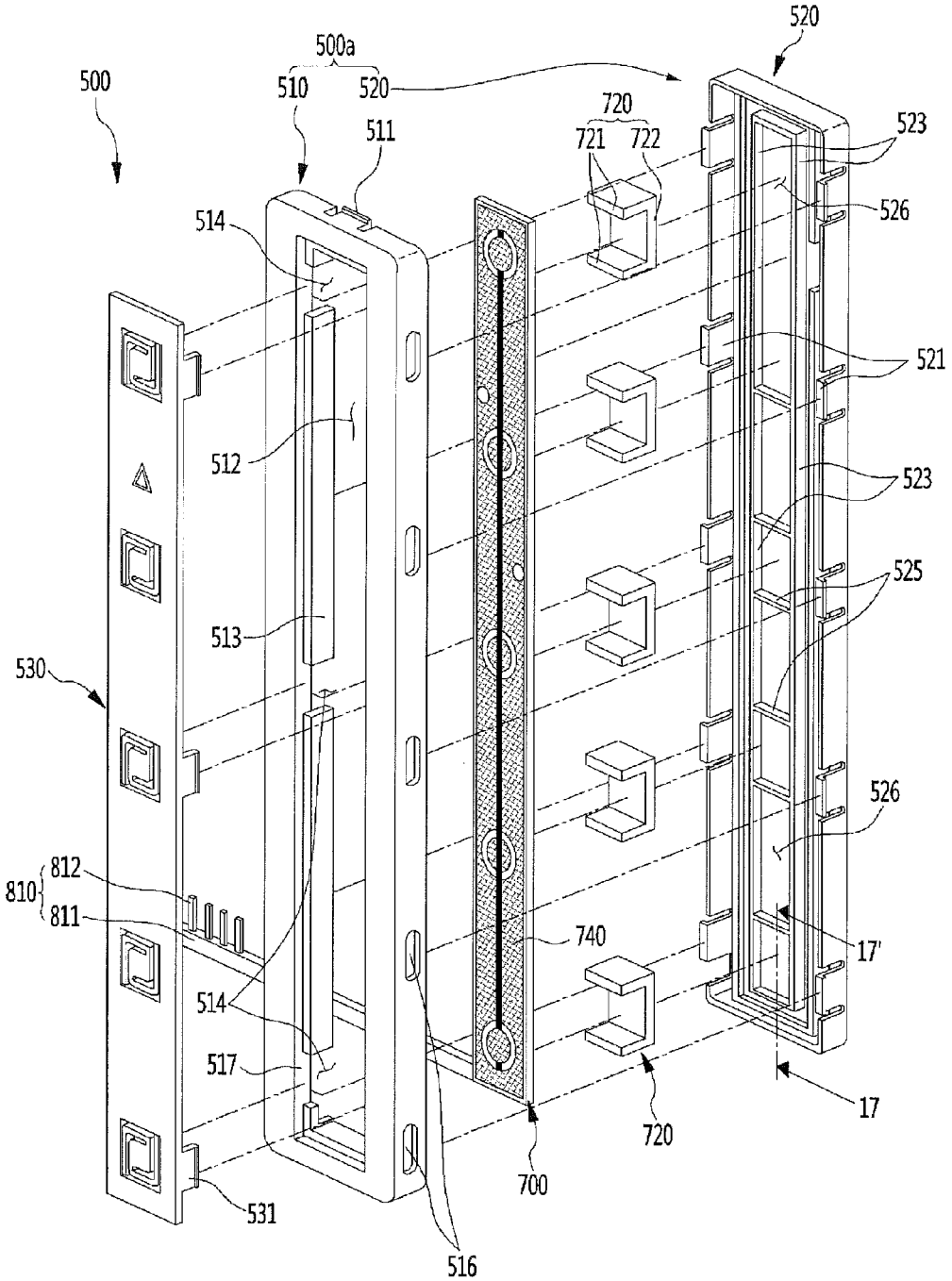
FIG. 16 is an exploded perspective view illustrating an example of a touch sensor assembly.
Figure 17:
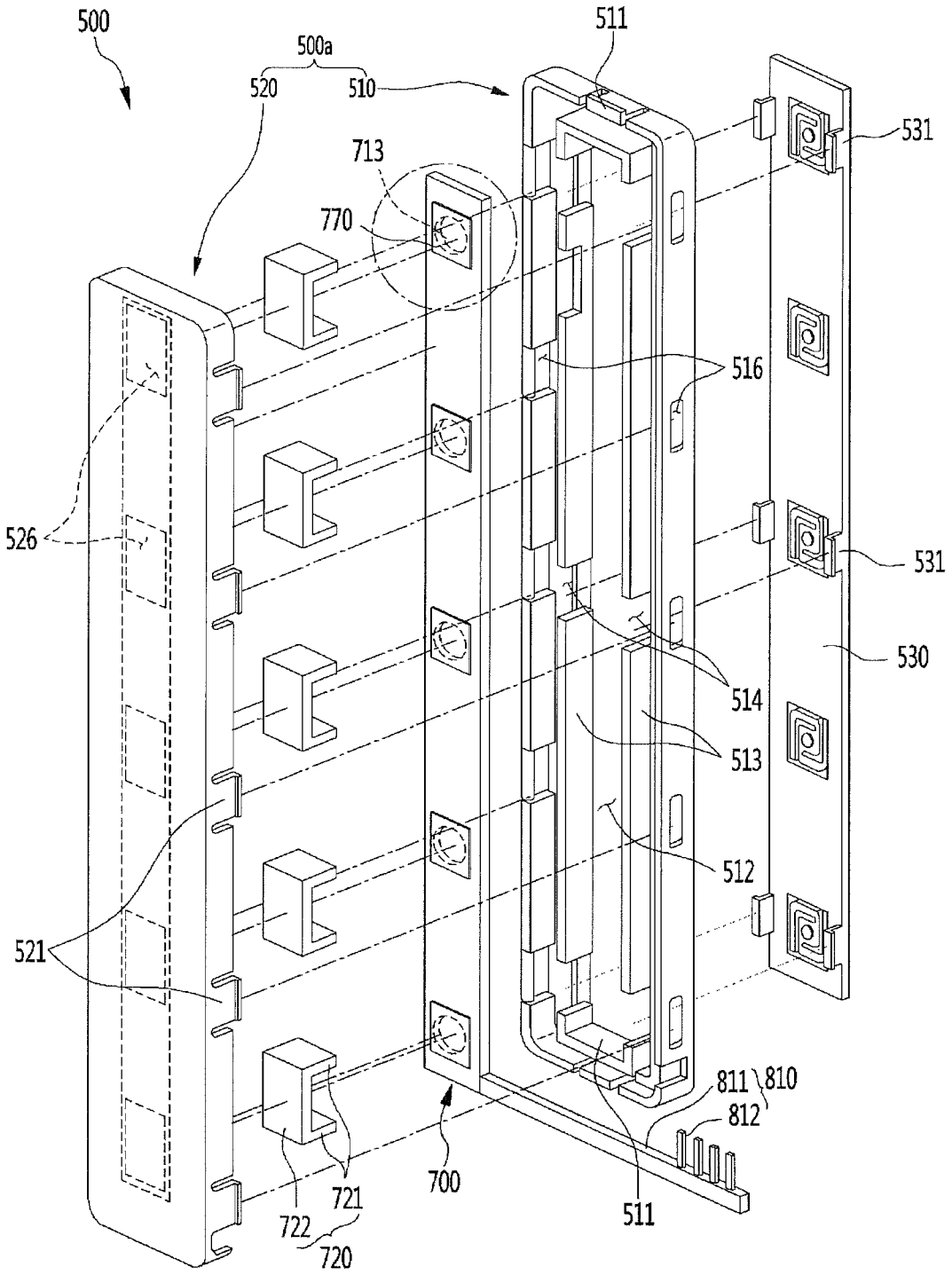
FIG. 17 is an exploded perspective view illustrating the touch sensor assembly seen from behind.

Housing coupling portions 511 which are hanged on upper and lower edges of the accommodation portion 210 may be formed at an upper and a lower ends of a sensor housing 500*a* (see FIG. 16) which defines an exterior of the touch sensor assembly 500. In addition, at least one of the housing coupling portions 511 formed at the upper and the lower ends of the sensor housing 500*a* is formed in a hook shape, a state in which the touch sensor assembly 500 is fixed to an inside of the accommodation portion 210 is maintained. That is, the touch sensor assembly 500 may be inserted into the inside of the accommodation portion 210 from a front of the display cover 200, the housing coupling portions 511 may be hanged on an edge of the accommodation portion 210, and the touch sensor assembly 500 is fixed and coupled to the display cover 200.

When the display cover 200 is attached to the rear surface of the front panel, the second through holes 220 formed at the front surface of the display cover 200 are aligned forward and backward with the first through holes 21. The second through holes 220 may also be opened in a shape corresponding to the seven segments (or eighty eight segments), and may also be formed in a shape of a plurality of simple holes to show other information.

Block portions 221 may be formed at edges of the second through holes 220. The block portions 221 may protrude from the edges of the second through holes 220 toward a front of the display cover 200.

The adhesive member 25 which is disposed at the front surface of the display cover 200 may be coated or attached to only an external region of the block portions 221. When the display cover 200 is attached to the rear surface of the front panel 20, a size of a gap formed between the first through hole 21 and the second through hole 220 may be minimized by a coating thickness of the adhesive member 25, and a phenomenon that light is leaked through the gap may be minimized. The block portions 221 are formed to have a height which effectively prevents a phenomenon in which light is leaked. Specifically, in consideration that the adhesive member 25 coated on the front surface of display cover 200 is compressed by pressure of the foam solution foamed into the door 10, the block portions 221 may protrude at a height less than a height before the adhesive member 25 is compressed.

Figure 12:
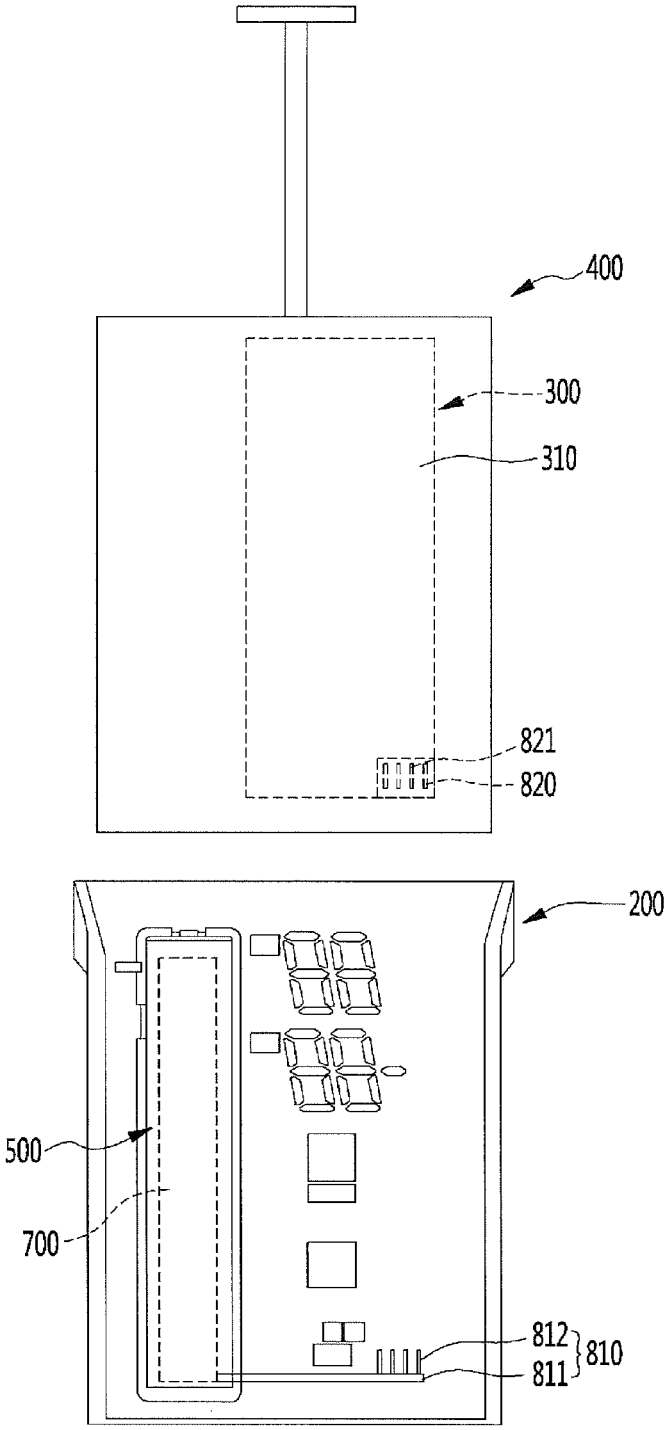
FIG. 12 is a rear view when the display cover and the display frame are separated.
Figure 13:
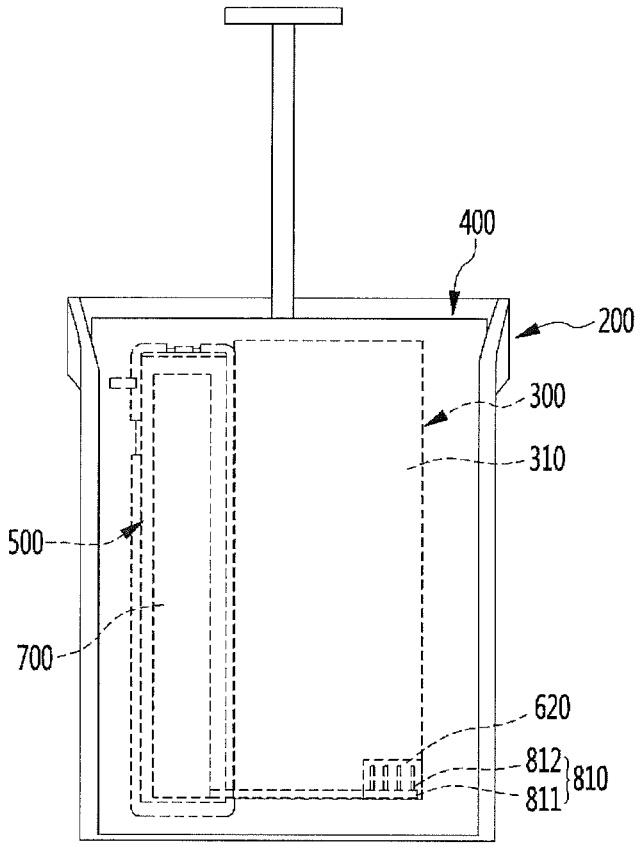
FIG. 13 is a rear view when the display cover and the display frame are coupled.

Referring to FIGS. 12 and 13, the sensor connector 810 is provided at a lower end of the sensor PCB 700 which constitutes the touch sensor assembly 500. The sensor connector 810 is a component which electrically connects the sensor PCB 700 and the display PCB 310 at an outer side of the touch sensor assembly 500. Accordingly, when the display assembly 300 is mounted on the display cover 200, the sensor PCB 700 may be electrically connected to the sensor controller 330 on the display PCB 310.

The sensor connector 810 may be provided with the PCB extension portion 811 which extends from the sensor PCB 700, and a terminal 812 formed at an end portion of the PCB extension portion 811. The PCB extension portion 811 may laterally extend from a lower end of the sensor PCB 700, and when the display assembly 300 is mounted on the display cover 200, the PCB extension portion 811 may extend to a position corresponding to a position of the display connector 820.

The PCB extension portion 811 may be integrally formed with the sensor PCB 700 by extending a part of a lower end of the sensor PCB 700 such that signals of touch sensors 750 mounted on the sensor PCB 700 are transmitted. In addition, the PCB extension portion 811 may be separately formed as a separate member, and coupled to the sensor PCB 700 to be electrically connected to the touch sensor 750 as necessary.

The terminal 812 may be formed to extend upward from an end portion of the PCB extension portion 811, and coupled to the display connector 820 provided on the display assembly 300 which is moved downward for assembly. That is, the terminal 812 may be formed in a type such as a plurality of pins, and may be inserted through a bottom surface of the display connector 820.

The display connector 820 may be provided at an edge of a lower end of the display PCB 310 which is the farthest side from the touch sensor assembly 500. The display connector 820 is electrically connected to the sensor controller 330 on the display PCB 310, and coupled to the sensor connector 810.

A lower end of the display connector 820 may be configured to engage with the terminal 812 of the sensor connector 810. For example, a terminal hole 821 into which the terminal 812 of the sensor connector 810 is inserted may be formed in the display connector 820. The sensor PCB 700 and the sensor controller 330 are electrically connected to each other by coupling the terminal 812 and the terminal hole 821.

Figure 14:
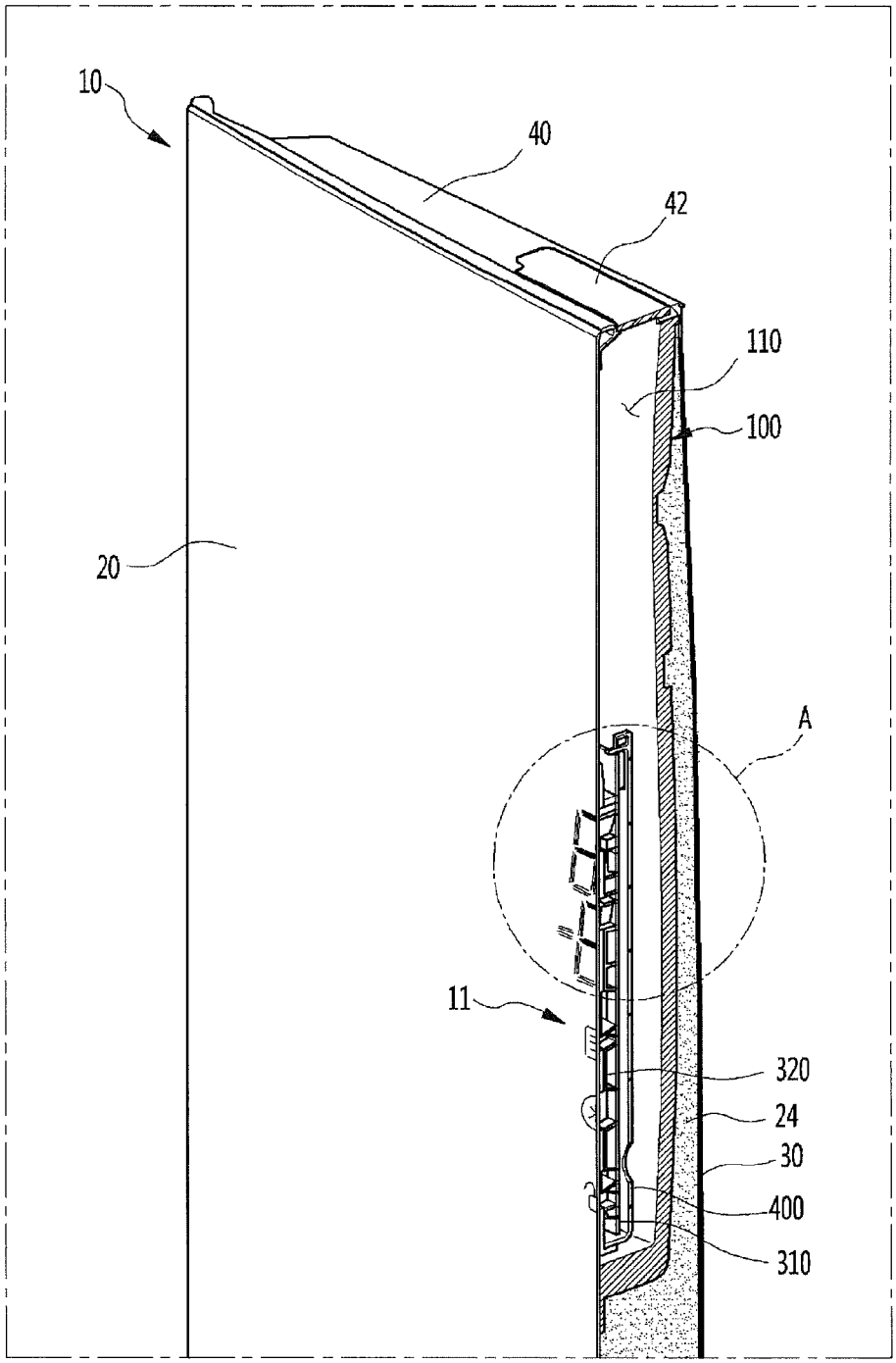
FIG. 14 is a cut away perspective view taken along line 14-14' of FIG. 2.
Figure 15:
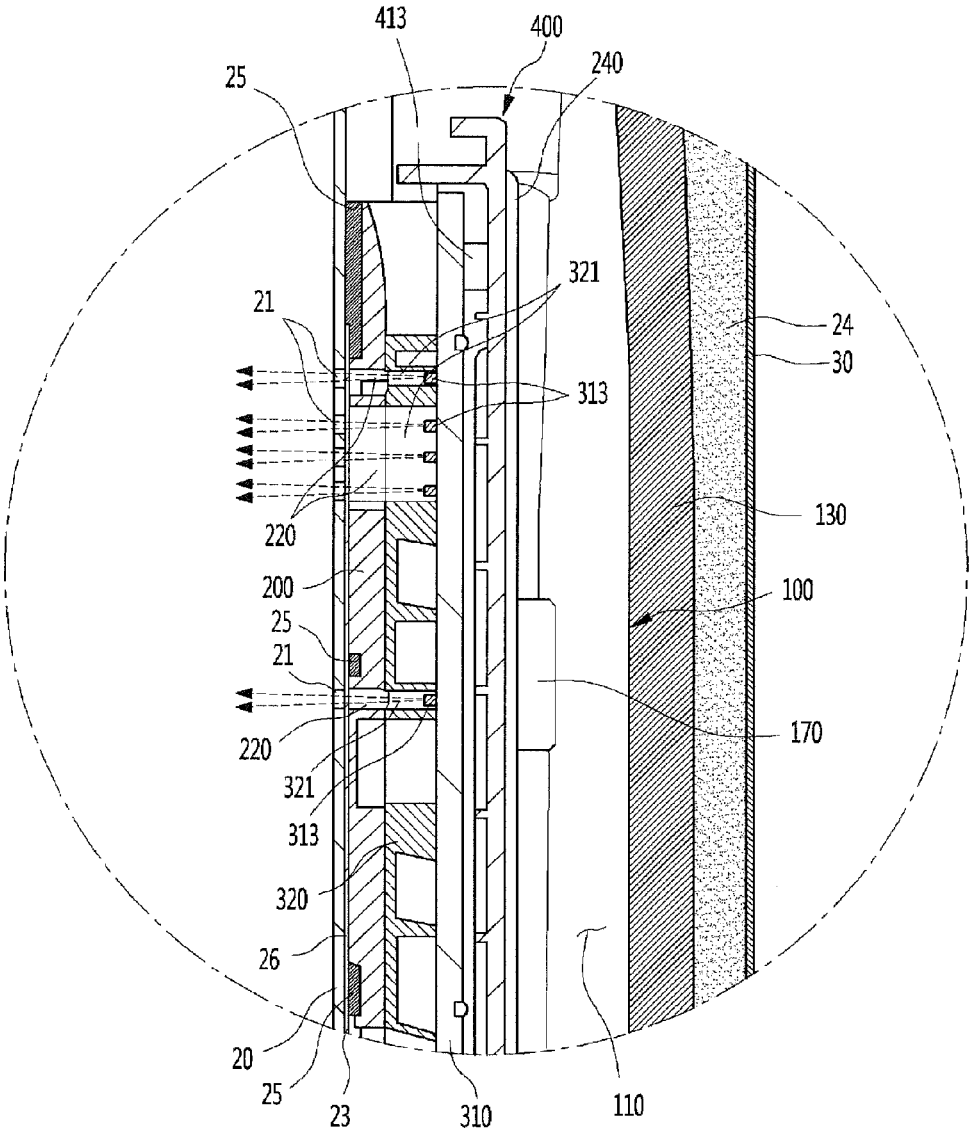
FIG. 15 is an enlarged cross-sectional view illustrating a portion A of FIG. 14.

Referring to FIGS. 14 and 15, in a state in which the display cover 200 is attached to the rear surface of the front panel 20 by the adhesive member 25, the first through hole 21 and the second through hole 220 are communicated with each other. A size of the first through hole 21 is formed much less than that of the second through hole 220, and the plurality of the first through holes 21 may be disposed in an inner region of one second through hole 220.

In addition, in a state in which the display frame 400 is completely inserted into the display cover 200 and the display assembly 300 is positioned at the inside of the display cover 200, the third through holes 321 are aligned forward and backward with the second through holes 220. Sizes and shapes of the second through hole 220 and the third through hole 321 are the same, and as the reflector 320 is pressed against the rear surface of the display cover 200, the third through holes 321 may be accurately aligned directly behind the second through holes 220.

The first to the third through holes 21, 220 and 321 communicate with each other from front to back, light emitted by the LED 313 may sequentially pass the third through holes 321, the second through holes 220, and the first through holes 21, and may be emitted to the outside of the door 10.

A diffusive sheet 26 may be attached at the rear surface of the front panel 20 corresponding to a region in which the first through holes 21 are formed. The diffusive sheet 26 may diffuse light emitted by the LED 313, and the light emitted through the display window 11 may evenly light the entire display window 11. In addition, when the diffusive sheet 26 is attached to the rear surface of the front panel 20 corresponding to a region of the display window 11, the diffusive sheet 26 also additionally performs a function to cover all of the first through holes 21.

Referring to FIGS. 14 and 15, the touch sensor assembly 500 may include the sensor housing 500*a* forming the exterior of the touch sensor assembly 500, the sensor PCB 700 accommodated in an inside of the sensor housing 500*a*, an elastic member 720 which supports the sensor PCB 700, and a touch booster 530 coupled to an opening 512 formed at a front side of the sensor housing 500*a*.

The sensor housing 500*a* includes a housing cover 510 and a housing body 520, and a space in which the sensor PCB 700 is accommodated is formed by the housing cover 510 and the housing body 520 being coupled to each other. The housing cover 510 may define a front and side surfaces of the touch sensor assembly 500, and the housing body 520 may define the rear surface of the touch sensor assembly 500. The side surfaces of the housing body 520 and side surfaces of the housing cover 510 may overlapped.

The housing cover 510 forms the front surface, left and right surfaces, and top and bottom surfaces of the sensor housing 500*a*, and the housing coupling portion 511 are formed at the top and bottom surfaces of the housing cover 510. The housing coupling portion 511, as described above, enables the touch sensor assembly 500 to be fixed and mounted in the accommodation portion of the display cover 200. In addition, in a state in which the touch sensor assembly 500 is mounted in the accommodation portion 210, a front surface of the housing cover 510 may be exposed to an outside of the display cover 200 and attached to the rear surface of the front panel 20 by the adhesive member 25.

The opening 512 is formed at the front surface of the housing cover 510, and the touch booster 530 is mounted on the opening 512. The touch booster 530 is a portion configured to transmit a movement displacement (the amount of displacement) of the front panel 20 which is generated when a user pushes and touches the front panel 20 to sensors 750.

The opening 512 is formed to have a size and a shape corresponding to those of the touch booster 530, and the opening 512 is covered by the touch booster 530. An extending rib 517 is formed to extend backward from the housing cover 510 at an edge of the opening 512, and is pressed against a side surface of the touch booster 530. As the side surface of the touch booster 530 is pressed against an inner circumferential surface of the extending rib 517, when the touch booster 530 moves forward or backward due to touch pressure, inclination or shake in a left and right direction is prevented.

In addition, booster support portions 513 may be respectively formed at left and right inner circumferential surfaces of the opening 512. The booster support portions 513 protrude from the extending rib 517 toward a center of the opening 512, and extend along the inner circumferential surfaces of the extending rib 517.

The booster support portions 513 may extend from a position spaced a predetermined distance behind a front end portion of the extending rib 517 toward a rear of the housing cover 510 to a predetermined width. A distance between a front end portion of the extending rib 517 and a front end portion of the booster support portion 513 may be actually slightly less than a thickness of the touch booster 530.

The booster support portion 513 supports left and right edges of a rear surface of the touch booster 530 in a state in which the touch booster 530 is installed thereat. Accordingly, even though touch pressure is applied to a front surface of the touch booster 530, the touch booster 530 itself is prevented from moving backward pasta predetermined position.

A plurality of hook grooves 514 are formed at the booster support portion 513, and the hook grooves 514 accommodate hooks 531 formed at the touch booster 530. The booster support portion 513 is divided into a plurality of pieces of the support portion by the plurality of hook grooves 514. When the touch booster 530 is mounted on the opening 512, the hooks 531 formed at the touch booster 530 pass through the hook grooves 514.

When the touch booster 530 is mounted on the housing cover 510, end portions of the hook 531 are hooked on end portions of the extending rib 517. In this state, when the touch booster 530 moves forward or backward by touch pressure, the end portions of the hook 531 are separated from a rear end of the extending rib 517. The forward and backward movement distance of the touch booster 530 is very small.

In addition, when the touch booster 530 moves forward or backward, the hook groove 514 prevents the touch booster 530 from being vertically shifted. That is, the touch booster 530 may be shaken only a minute distance forward or backward by touch pressure in a state in which the touch booster 530 is coupled to the housing cover 510.

In addition, as described above, in a state in which the touch booster 530 is assembled at the housing cover 510, the front surface of the touch booster 530 may protrude forward slightly more than the housing cover 510. Accordingly, when the touch sensor assembly 500 and the display cover 200 are attached to the rear surface of the front panel 20, a state in which the touch booster 530 is strongly pressed against the rear surface of the front panel 20 may be maintained (see a cross-sectional view of FIG. 26). A minute touch pressure which is applied to the front surface of the front panel 20 may also be transmitted to the touch booster 530.

Cover coupling portions 516 may be formed at a side surface of the housing cover 510. The cover coupling portions 516 are a portion in which body coupling portions 521 formed at the housing body 520 are inserted, and are formed in a groove or hole shape so that the body coupling portions 521 having a hook shape are hanged and the housing body 520 is coupled to the housing cover 510.

When the body coupling portions 521 are fastened to the cover coupling portions 516, it is preferable that the cover coupling portions 516 be formed at positions at which a plurality of elastic members 720 provided at the sensor PCB 700 are compressed uniformly.

Figure 18:
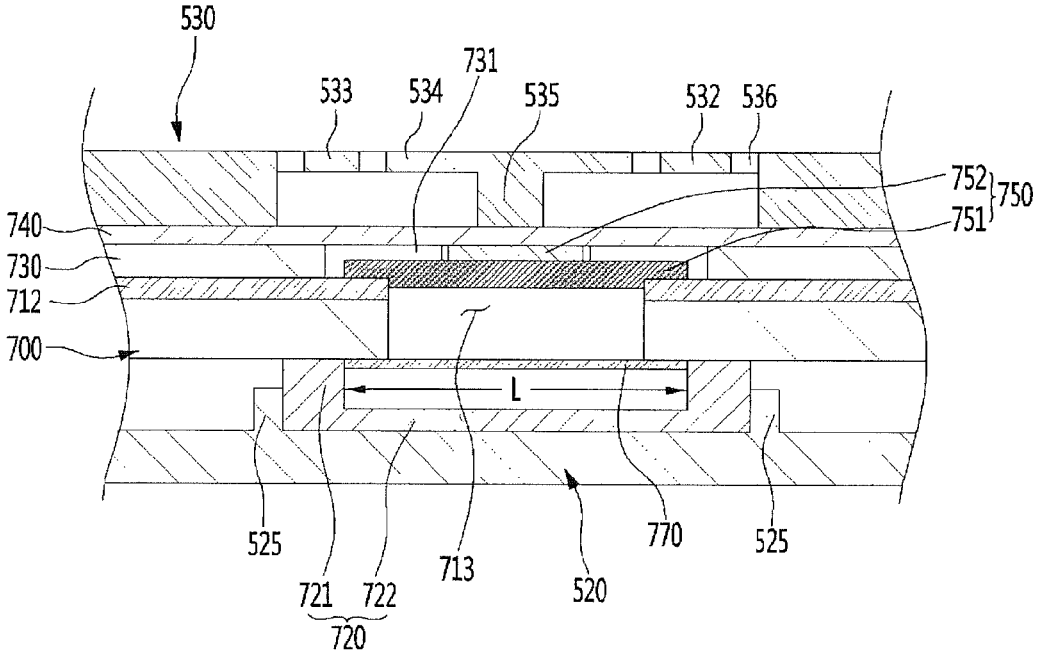
FIG. 18 is a longitudinal sectional view illustrating the touch sensor assembly.
Figure 19:
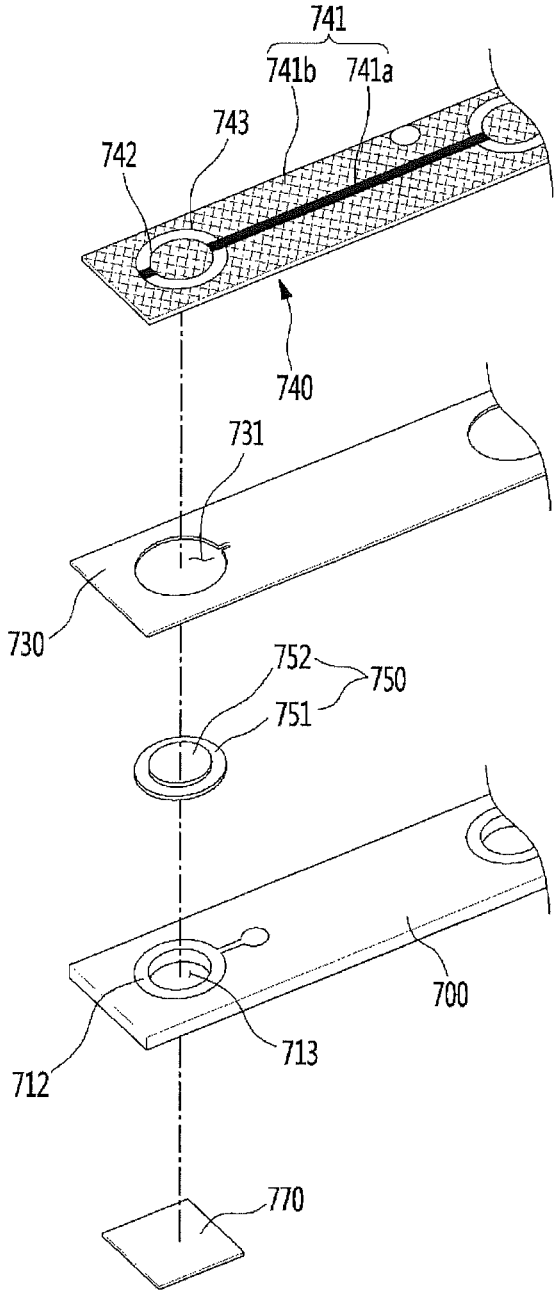
FIG. 19 is an exploded perspective view illustrating a coupling structure of a touch sensor which constitutes the touch sensor assembly.
Figure 20:
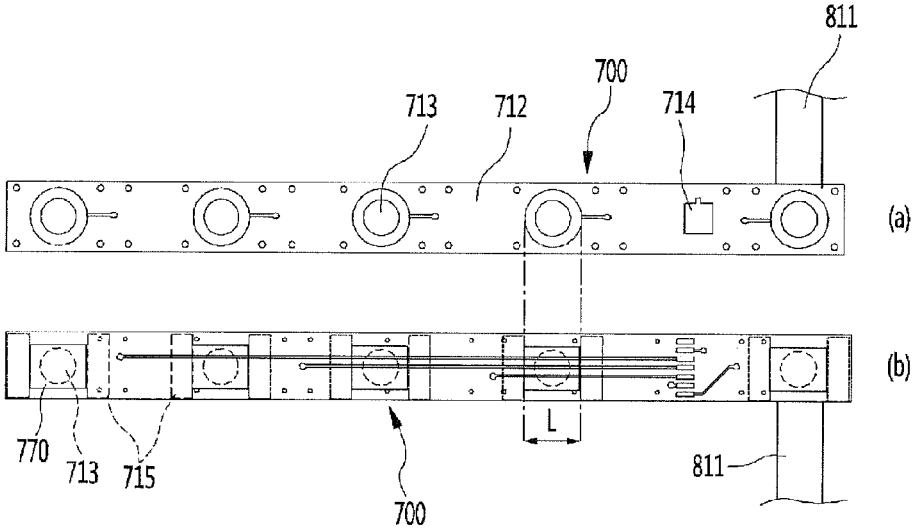
FIG. 20 shows a plan view (a) and a rear view (b) illustrating a sensor PCB which constitutes the touch sensor assembly.

When the housing cover 510 and the housing body 520 are coupled, it is preferable that the elastic members 720 be uniformly compressed by uniform pressure, and uniformly push forward the sensor PCB 700 and the touch booster 530. To this end, the positions of the cover coupling portions 516 and the body coupling portions 521 may be positioned between upper and lower ends of the sensor 750 (see FIG. 18). Thus, the elastic members 720 may be compressed uniformly.

Accordingly, as the touch booster 530 always slightly protrudes forward from the front surface of the housing cover 510, a state in which the touch booster 530 is pressed against the front panel 20 may be maintained, and when a user touches the front surface of the front panel 20, the touch booster 530 may effectively sense touch pressure. A structure and a function of the sensor PCB 700 and the elastic member 720 will be described in detail below with reference to following drawings.

The housing body 520 is coupled to the housing cover 510, forms an exterior of a rear portion of the touch sensor assembly 500, and forms a space in which the sensor PCB 700 is installed. The housing body 520 may be formed with a rear side portion and side portions which extend forward from four edges of the rear side portion.

In addition, a plurality of body coupling portions 521 may be formed at a side surface of the housing body 520. The body coupling portions 521 may be formed by a part of a side portion of the housing body 520 being cut, be inserted into the cover coupling portions 516, and maintain a state in which the housing cover 510 and the housing body 520 are coupled to each other.

The plurality of cover coupling portions 516 and the body coupling portions 521 may be disposed at equal intervals in a lengthwise direction of the touch sensor assembly 500. In addition, left cover coupling portions 516 and right cover coupling portions 516 are formed at the same heights, which is also similar to the plurality of body coupling portions 521. Accordingly, when the housing cover 510 is coupled to the housing body 520, since the same force is applied to the elastic members 720, the elastic members 720 may be prevented from being inclined in one direction while the touch sensor assembly 500 is assembled.

The sensor PCB 700 may be formed by a spacer 730, the sensor 750, and a conductive foil 740 being attached, and is supported by the elastic member 720 inside the sensor housing 500*a*. In addition, the touch booster 530 is mounted on the opening 512 directly behind the front panel 20 to shake forward or backward. In addition, as described above, the sensor connector 810 is provided at a lower end of the sensor PCB 700. The sensor connector 810 may include the PCB extension portion 811 and the terminal 812, and may be laterally extended by penetrating the housing body 520 and a housing cover 510.

In addition, a state in which the touch booster 530 contacts the front panel 20 may be always maintained, and a forward and backward movement displacement of the front panel 20 generated when a user touches the touch operation unit 12 of the front panel 20 may be immediately transmitted to the sensor 750.

The elastic member 720 is fixedly mounted on the housing body 520. The elastic member 720 may be formed of a silicone having elasticity, or a synthetic rubber and a resin material having elasticity similar thereto. For example, the elastic member 720 may be formed of a silicone material, and a silicone material having hardness of about 15 to 25 (shore A) may be used. More preferably, a silicone material having hardness of about 20 (shore A) may be used.

When the hardness of the elastic member 720 is too high, a touch operation of the touch sensor 750 is not smoothly performed, and thus, there is a problem in that a user strongly pushes the touch operation unit 12 so that the touch sensor 750 recognizes a touch pressure. On the contrarily, when the hardness of the elastic member 720 is too low, there is a problem in that the sensor PCB 700 is not pressed against the front panel 20. Accordingly, the elastic member 720 which has hardness to have an excellent sensitivity of a touch operation and simultaneously press the sensor PCB 700 against the front panel 20 is required.

In addition, as the elastic member 720 having specific hardness is manufactured to have a specific color, for example, blue, products having the same hardness may be used and prevent mixing of products having different hardness during an assembly process.

The elastic member 720 may include a pair of support portions 721 perpendicular to the sensor PCB 700 toward a rear surface (or a bottom surface) of the sensor PCB 700, and an extension portion 722 which connects the pair of support portions 721. That is, as the elastic member 720 is formed in an n shape, one ends of the pair of support portions 721 may be pressed against a rear surface of the sensor PCB 700 and the other ends thereof may be connected by the extension portion 722.

The pair of support portions 721 are formed to be pressed against the rear surface of the sensor PCB 700 in the outside of an outer edge of the touch sensor 750, and are formed to support the sensor PCB 700. Accordingly, in a state in which the support portion 721 is in contact with the sensor PCB 700, the support portion 721 is not affected on an operation or deformation of the touch sensor 750.

Figure 21:
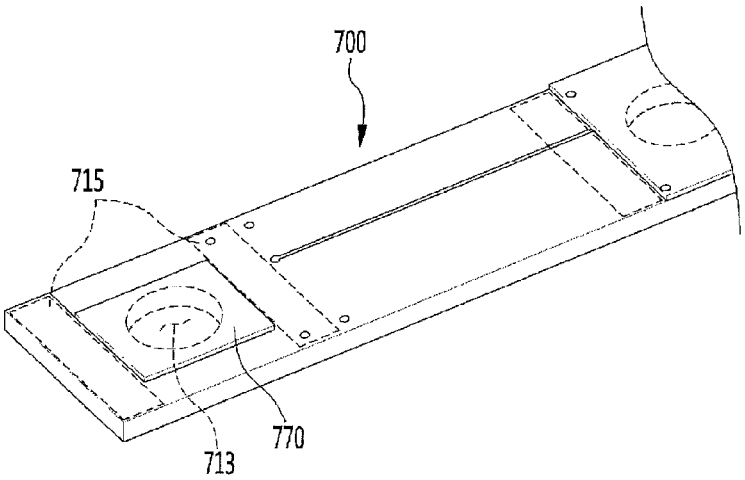
FIG. 21 is a partial perspective view when a cover member is mounted on the sensor PCB.

One ends of the pair of support portions 721 are disposed to be in correct contact with installation mark portions 715 (see FIG. 21) marked on the rear surface of the sensor PCB 700. In addition, when necessary, the ends of the support portions 721 may also be adhered to the installation mark portions 715 by an adhesive member.

The support portion 721 may be formed to have a length for pressing the sensor PCB 700 toward the touch booster 530, that is, the front panel 20, while compressing the support portion 721 when the housing body 520 and the housing cover 510 are coupled.

The extension portion 722 connects the other ends of the pair of support portions 721. In addition, the extension portion 722 is in contact with a bottom surface of the housing body 520.

In addition, since the pair of sensor support portions 721 are disposed at positions facing each other based on the touch sensor 750 by the extension portion 722, a pressure may be uniformly transferred to the sensor PCB 700. When a pressure is applied on the touch sensor 750, the touch sensor 750 may not be inclined in a side direction, and may be always maintained in a parallel state with the front panel 20.

Installation guides 523 and fixing ribs 525 may be formed on a rear side portion (or a bottom surface) of the housing body 520. A surface on which the installation guide 523 and the fixing rib 525 are formed may be defined as the rear side portion in a state in which the housing body 520 is stood, and may be defined as the bottom surface in a state in which the housing body 520 lies on a horizontal surface.

The installation guide 523 and the fixing rib 525 guide mounting of a plurality of elastic members 720, and form a space, that is, form an elastic member accommodation portion 526, to accommodate the elastic member 720 attached onto the sensor PCB 700.

In addition, since the hardness of the housing body 520 is reinforced by the installation guide 523 and the fixing rib 525, there is also an additional effect in that the housing body 520 is prevented from being twisted or deformed.

The installation guides 523 may protrude from each of a left edge and a right edge of a bottom portion of the housing body 520 and may extend in a lengthwise direction of the housing body 520. In addition, as the fixing rib 525 extends in a direction of crossing a direction of extending the installation guide 523, the fixing rib 525 divides a space defined between the pair of installation guides 523 into a plurality of small spaces. In addition, as the plurality of small spaces are each formed in a size corresponding to a size of the elastic member 720, the plurality of small spaces may be defined as elastic member accommodation portions 526 which accommodate the elastic member 720.

The pair of installation guides 523 may be formed to be spaced by a gap corresponding to a width of the sensor PCB 700. That is, a distance between outer surfaces of the pair of installation guides 523 is set to correspond to a width of the sensor PCB 700, and thus, edges of a rear surface of the sensor PCB 700 are supported by the pair of installation guides 523.

In addition, a distance between inner surfaces of the installation guides 523, that is, a length of an inner space formed by the pair of installation guides 523, may be equal to or slightly greater than a length of the elastic member 720. Thus, the elastic member 720 may be positioned in an inner region of the installation guide 523, and an inner surface of the pair of installation guides 523 supports a left and a right surface of the elastic member 720. As a result, when the elastic member 720 is compressed by a pressure of a user's touch, the elastic member 720 may be prevented from being twisted or inclined in a left or right direction, and thus the sensor PCB 700 may be stably supported.

In addition, the fixing ribs 525 vertically divide a space formed inside the pair of installation guides 523 into a plurality of spaces and form spaces in which the elastic members 720 are formed, that is, elastic member accommodation portions 526. The fixing rib 525 may protrude in a height equal to a height of a protrusion height of the installation guide 523, and may extend in a direction perpendicular to the installation guide 523.

Accordingly, the elastic member accommodation portion 526 may be defined by the installation guide 523 and the fixing rib 525. The elastic member accommodation portion 526 is formed in a size for accommodating a bottom surface of the elastic member 720, that is, one surface of the extension portion 722 and the pair of support portions 721.

Referring to FIGS. 18 to 21, the sensor PCB 700 may be formed of a plastic material.

Specifically, a copper coating film 712 which constitutes a circuit is printed on a front surface (a top surface in the drawing) of the sensor PCB 700. In addition, the sensor 750 which senses a movement displacement of the front panel 20 which is generated by a user's touch is provided at the front surface of the sensor PCB 700.

The sensor 750 may include a piezo sensor, and more specifically, may include a metal plate 751, and a ceramic element 752 attached on a front surface of the metal plate 751 (a top surface in the drawing). The metal plate 751 is elastically deformed by touch pressure generated when a user touches the front surface of the front panel 20. In addition, the ceramic element 752 generates electricity by the touch pressure. The piezo sensor is a pressure sensing sensor widely known, and a more specific description about the principle of the piezo sensor is omitted.

In some examples, the sensor 750 may be formed in various shapes.

The sensor 750 may be formed in plural number according to the sensor PCB 700, and a sensor support portion 713 may be formed at the front surface of the sensor PCB 700 in which the sensor 750 is installed.

The sensor support portion 713 may be defined as a groove or hole having a size (or a diameter) less than that of the sensor 750 (or a circular shaped sensor). Accordingly, an edge of a rear surface (or a bottom surface) of the metal plate 751 which constitutes the sensor 750 is supported by an edge of a front surface (or a top surface) of the sensor support portion 713. The sensor support portion 713 protrudes in a boss shape whose inside may be empty, that is, not a groove or hole shape, and the sensor 750 may be positioned at a top surface of the boss.

When the sensor support portion 713 and the sensor 750 have a circular shape, a diameter of the sensor support portion 713 may be formed less than that of the metal plate 751, and may be formed greater than that of the ceramic element 752. Accordingly, the metal plate 751 may be immediately deformed by touch pressure applied to the front panel 20, and the ceramic element 752 may effectively sense a change of pressure applied to the sensor 750.

Meanwhile, when the sensor support portion 713 is formed in a hole shape, a cover member 770 may be attached onto a rear surface of the sensor PCB 700 on which the sensor support portion 713 is formed.

As the cover member 770 is formed to be larger than the sensor support portion 713, the cover member 770 may completely cover an opened rear surface of the sensor support portion 713. According to the above-described structure, a front surface and the rear surface of the hole-shaped sensor support portion 713 are respectively covered by the touch sensor 750 and the cover member 770.

As the cover member 770 is completely adhered to the rear surface of the sensor PCB 700 by an adhesive, air tightness inside the sensor support portion 713 may be maintained. Accordingly, the cover member 770 may prevent moisture from penetrating inside the sensor support portion 713, and may prevent corrosion of the touch sensor 750.

Specifically, as the cover member 770 is attached onto the rear surface of the sensor PCB 700 in a shape of a film sheet having the same size as that of the sensor PCB 700, the cover member 770 may simultaneously cover all of a plurality of the sensor support portions 713 formed at the sensor PCB 700.

Alternatively, the number of the cover members 770 may be provided to correspond to the number of the plurality of the sensor support portions 713 formed at the sensor PCB 700. That is, the cover member 770 may be formed in a size so that the cover member 770 is interposed between a pair of elastic members 720 facing each other around the sensor support portion 713 so that one cover member 770 covers one sensor support portion 713.

A common contact point 714 connected by positive electrodes of a plurality of sensors 750 and the circuit is formed at one side of the sensor PCB 700. The common contact point 714 electrically connects rear surfaces of the plurality of the sensors 750. In addition, when the conductive foil 740 is adhered to a front surface of the copper coating film 712, the common contact point 714 contacts a central conductive line 741*a* formed at the conductive foil 740, and is electrically connected to negative electrodes of the plurality of the sensors 750. Thus, a current flows to the sensors 750.

Installation mark portions 715 which mark exact positions of the elastic members 720 may be formed at a rear surface of the sensor PCB 700. The installation mark portions 715 may be formed by printing or processing, and may be formed to show positions in which the elastic members 720 are installed. That is, when the elastic members 720 are mounted in the installation mark portions 715, the elastic members 720 are mounted at correct positions.

The installation positions of the elastic members 720, that is, the positions of the installation mark portions 715 are formed at an outside of the sensor 750, and formed at positions to face each other. In addition, the installation mark portions 715 which face each other may be formed at the same distance from a center of the sensor support portion 713.

In addition, it is preferable that the positions of the installation mark portions 715 be positioned at more outer positions than outside ends of the sensors 750. Specifically, a separation distance L between the installation mark portions 715 which face each other based on the center of the sensor 750 may be defined as a distance L between inner surfaces of the pair of support portions 721 which constitute the elastic member 720. In addition the separation distance L may be greater than an external diameter of the sensor 750, specifically, the metal plate 751. Accordingly, the elastic member 720 may not be interfered with the sensor 750 in a direction in which touch pressure is transmitted, and thus the sensibility of the sensor 750 may be prevented from being reduced.

In addition, a plane which passes a center of each of the plurality of the sensors 750 and a plane which equally divides each of the body coupling portions 521 and each of the cover coupling portions 516 may be the same plane. In other words, in FIG. 14, the body coupling portion 521 and the cover coupling portion 516 may be vertically and equally divided by a horizontal plane which passes a center of the sensor 750. Thus, uniform pressure is applied to the entire sensor PCB 700 positioned at an inside of the sensor housing 500*a*, and the plurality of sensors 750 may sense a user's operation signal under the same condition.

Figure 22:
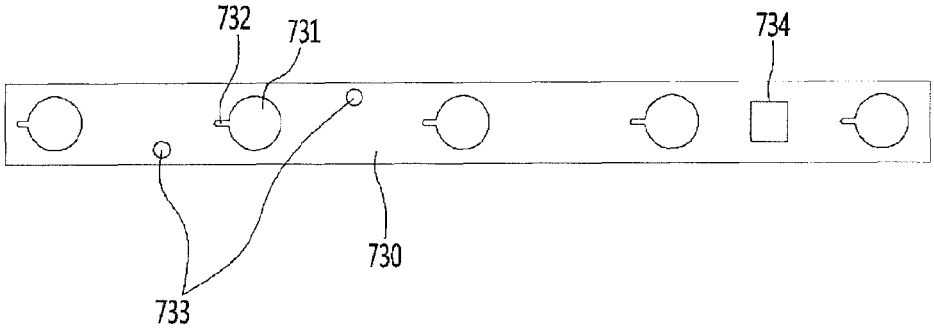
FIG. 22 is a plan view illustrating a spacer which constitutes the touch sensor assembly.

Referring to FIG. 22, the spacer 730 may be interposed between the copper coating film 712 and the conductive foil 740 of the sensor PCB 700. The spacer 730 adheres the conductive foil 740 to the front surface of the sensor PCB 700, and may include an adhesive member such as a double sided tape. In some examples a plurality of holes may be formed in the spacer 730.

Specifically, when the spacer is attached at the sensor PCB 700, the holes formed at the spacer 730 may include a plurality of sensor holes 731 formed at positions corresponding to the sensors 750, and a contact hole 734 may be formed at a position corresponding to the common contact point 714 of the copper coating film 712. When the conductive foil 740 is attached to a front surface (or a top surface) of the spacer 730 by the holes, the conductive foil 740 may contact the sensor 750 and the common contact point 714.

The sensor hole 731 may be greater than the sensor 750, and the sensor 750 may be accommodated in an inside of the sensor hole 731. Accordingly, when the sensor 750 is deformed by touch pressure, the sensor is not interfered with the spacer 730.

In addition, bent holes 732 may be respectively formed at edges of the sensor holes 731. When the spacer 730 is attached on the copper coating film 712, the bent holes 732 serve as a path through which bubbles present between the spacer 730 and the copper coating film 712 are quickly discharged to the outside. Specifically, the bent hole 732 is formed to extend in a predetermined length in a lengthwise direction of the spacer 730, and extends from an edge of the sensor hole 731 in one direction. The reason is that, the spacer 730 is provided in a film shape, and when the spacer 730 is attached to the copper coating film 712, the spacer 730 sequentially is attached from an end portion of one side of the copper coating film 712 toward an end portion of the other side of the copper coating film 712. Accordingly, the bent hole 732 may extend from the edge of the sensor hole 731 in the same direction as a direction toward which the spacer 730 is attached in a predetermined length.

In addition, when the spacer 730 and the conductive foil 740 are attached on the copper coating film 712, guide portions may be provided at the spacer 730 and the conductive foil 740 so that the spacer 730 and the conductive foil 740 are attached to correct positions.

The guide portion may include through holes 733 and 744 provided at the spacer 730 and the conductive foil 740. In addition, the through holes 733 and 744 may be formed in plural number in a lengthwise direction of the spacer 730 and the conductive foil 740, and may be alternately disposed at one side edge and the other side edge in a widthwise direction of the spacer 730 and the conductive foil 740.

In addition, in the sensor PCB 700, alignment rods are disposed at positions corresponding to the through holes 733 and 744. In addition, when the spacer 730 and the conductive foil 740 are attached to the sensor PCB 700, the alignment rods pass through the through holes 733 and 744. In addition, after the spacer 730 and the conductive foil 740 are sequentially attached to the sensor PCB 700, the alignment rods may be removed from the sensor PCB 700. The spacer 730 and the conductive foil 740 may be attached to correct positions on the sensor PCB 700 by the guide portion. In other words, the center of the sensor 750 may match a center of the sensor hole 731 of the spacer 730. In addition, the center of the sensor 750 may match a center of the contact portion 745 of the conductive foil 740 provided to the sensor PCB 700.

Figure 23:
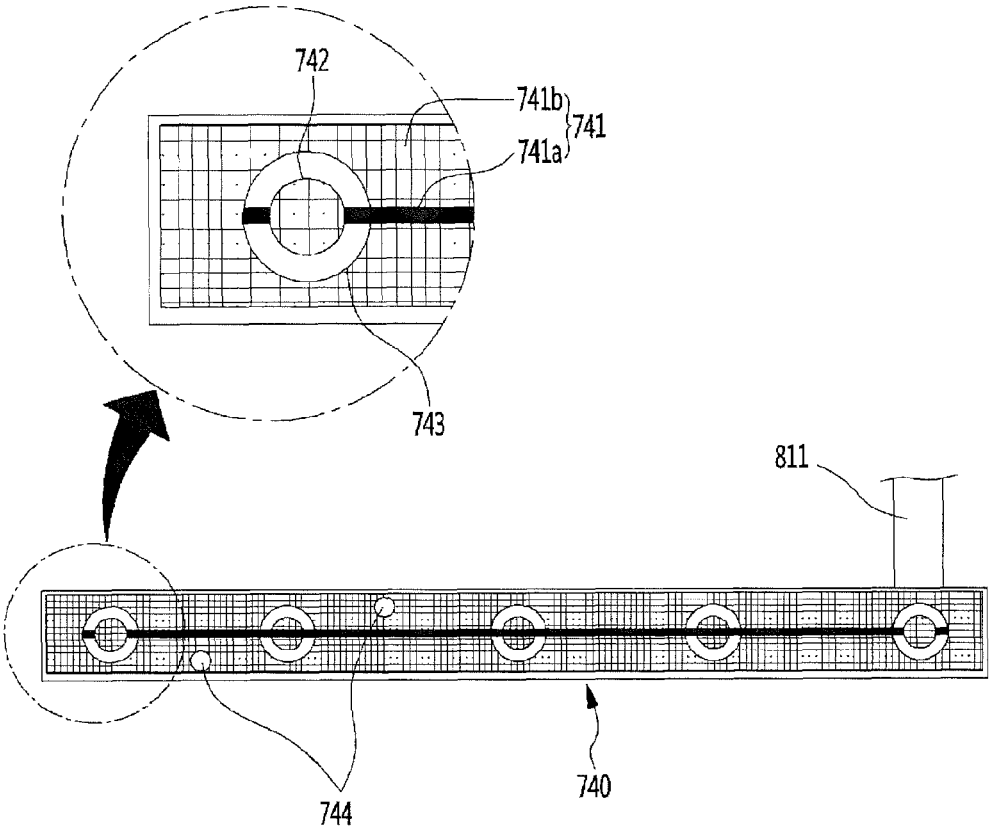
FIG. 23 is a plan view illustrating a conductive foil which constitutes the touch sensor assembly.

Referring to FIG. 23, the conductive foil 740 may be formed of a transparent resin film material such as polyethylene terephthalate (PET), and may be formed to have a size corresponding to the sensor PCB 700 and the spacer 730.

In addition, a conductive line 741 which connects all of top surfaces of the plurality of touch sensors 750 and the common contact point 714 formed at the copper coating film 712 may be formed at a rear surface (or a bottom surface) of the conductive foil 740. The conductive line 741 may be printed using a silver material at a rear surface of the conductive foil 740.

In addition, a surface in which the conductive line 741 is printed is formed to extend to contact a front surface (or a top surface) of the spacer 730 and to simultaneously contact the touch sensor 750 and the common contact point 714. The conductive line 741 may include the central conductive line 741*a* which extends from a center of the conductive foil 740 in a lengthwise direction of the conductive foil 740, and a peripheral conductive line 741*b* which is connected to the central conductive line 741*a* and is formed to extend in a grid shape or mesh shape over an entire surface of the conductive foil 740. In addition, the central conductive line 741*a* contacts all of a top surface of the touch sensor 750 and the common contact point 714.

An inner guide line 742 which enables the touch sensor 750 to be attached on a correct position may be formed in a circular shape at the rear surface of the conductive foil 740, and the peripheral conductive line 741*b* having the grid shape may also be formed at an inside of the inner guide line 742. In addition, the central conductive line 741*a* is connected to the inner guide line 742.

In addition, an outer guide line 743 having a diameter greater than a diameter of the inner guide line 742 may be formed at an outside of the inner guide line 742. The inner guide line 742 and the outer guide line 743 are also a part of the peripheral conductive line 741*b* having the grid shape, and are formed of a silver material. In addition, the inner guide line 742 and the outer line 743 are bisected by the central conductive line.

The inner guide line 742 may be formed to correspond to a size of the ceramic element 752, and the outer guide line 743 may be formed to correspond to a size of the metal plate 751. Accordingly, in a state in which the touch sensor 750 is mounted at a correct position, an edge of the ceramic element 752 may positioned to contact the inner guide line 742 and an edge of the metal plate 751 may be positioned to contact the outer guide line 743.

The central conductive line 741*a* extends from a center of the rear surface of the conductive foil 740 in a lengthwise direction of the conductive foil 740, and connects a plurality of outer guide lines 743 and inner guide lines 742.

The conductive line 741 connects the common contact point 714 and the top surface of the touch sensor 750, that is, a negative electrode, and thus an electric current may be applied to the touch sensor 750.

When a signal is generated by a touch, a noise may be reduced by the peripheral conductive line 741*b* having the grid shape or mesh shape. In addition, since a conductive line having a grid shape is not formed between the outer guide line 743 and the inner guide line 742, when the front panel 20 is pushed and deformed, deformation of the front panel 20 may be effectively transmitted to the touch sensor 750.

Figure 24:
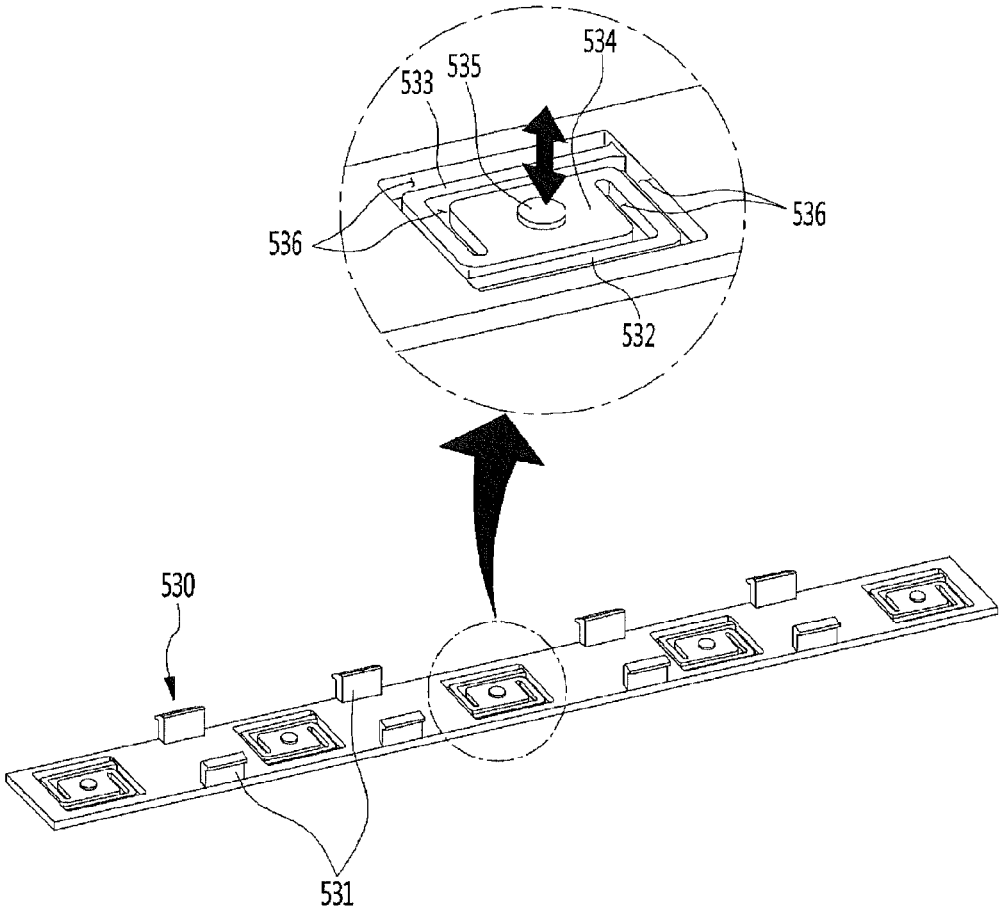
FIG. 24 is a perspective view illustrating a rear surface of a touch booster which constitutes the touch sensor assembly.

Referring to FIG. 24, the touch booster 530 may be formed to have a size corresponding to the opening 512 of the housing cover 510, and formed to cover the opening 512. The hooks 531 formed at left and right sides of the touch booster 530 are coupled to the hook grooves 514 formed at the housing cover 510, and are formed in plural number. In addition, the hooks 531 are formed to shake forward or backward in an inside of the hook groove 514.

A plurality of elastic deformation portions corresponding to the number of the sensors 750 may be formed at the touch booster 530. The elastic deformation portions are formed at positions corresponding to positions of the touch operation units 12 and the sensors 750 of the front panel 20, and are formed to have a structure which is elastically deformable forward or backward. When a user pushes the touch operation unit 12, the touch operation unit 12 moves backward according to deformation of the front panel 20, and presses the elastic deformation portion. The elastic deformation portion presses the sensor 750. In addition, when a user detaches a hand from the touch operation unit 12, the elastic deformation portion returns to the original position.

Specifically, the elastic deformation portion may include a first extension portion 532 which extends from an edge of one side of an opening formed at the touch booster 530 and is bent, a second extension portion 533 which extends from an edge of the other side of the opening and is bent, and a common portion 534 which is disposed at a center of the opening to connect end portions of the first extension portion 532 and the second extension portion 533. In addition, the second extension portion 533 may extend from a side opposite to the first extension portion 532.

The first extension portion 532 and the second extension portion 533 may be configured to have a narrow width, to extend, to be bent at least one time, and to be elastically deformable so that the common portion 534 moves in a direction of pressing and returns to the original position. The first extension portion 532 and the second extension portion 533 may extend and be bent along an edge of the common portion 534, and may be symmetrically formed with respect to a plane which passes a diagonal line of the common portion 534.

A remaining portion except the first extension portion 532, the second extension portion 533, and the common portion 534 forms a cut portion 536. In addition, the protrusion 535 may be formed to extend at a rear surface of the common portion 534. The protrusion 535 is positioned at a center of the rear surface of the common portion 534, and is aligned with a center of the sensor 750. In addition, the protrusion 535 is formed to maintain a contact state with an upper surface of the conductive foil 740. Accordingly, when the common portion 534 moves backward, a central portion of the sensor 750 is pressed.

Figure 25:
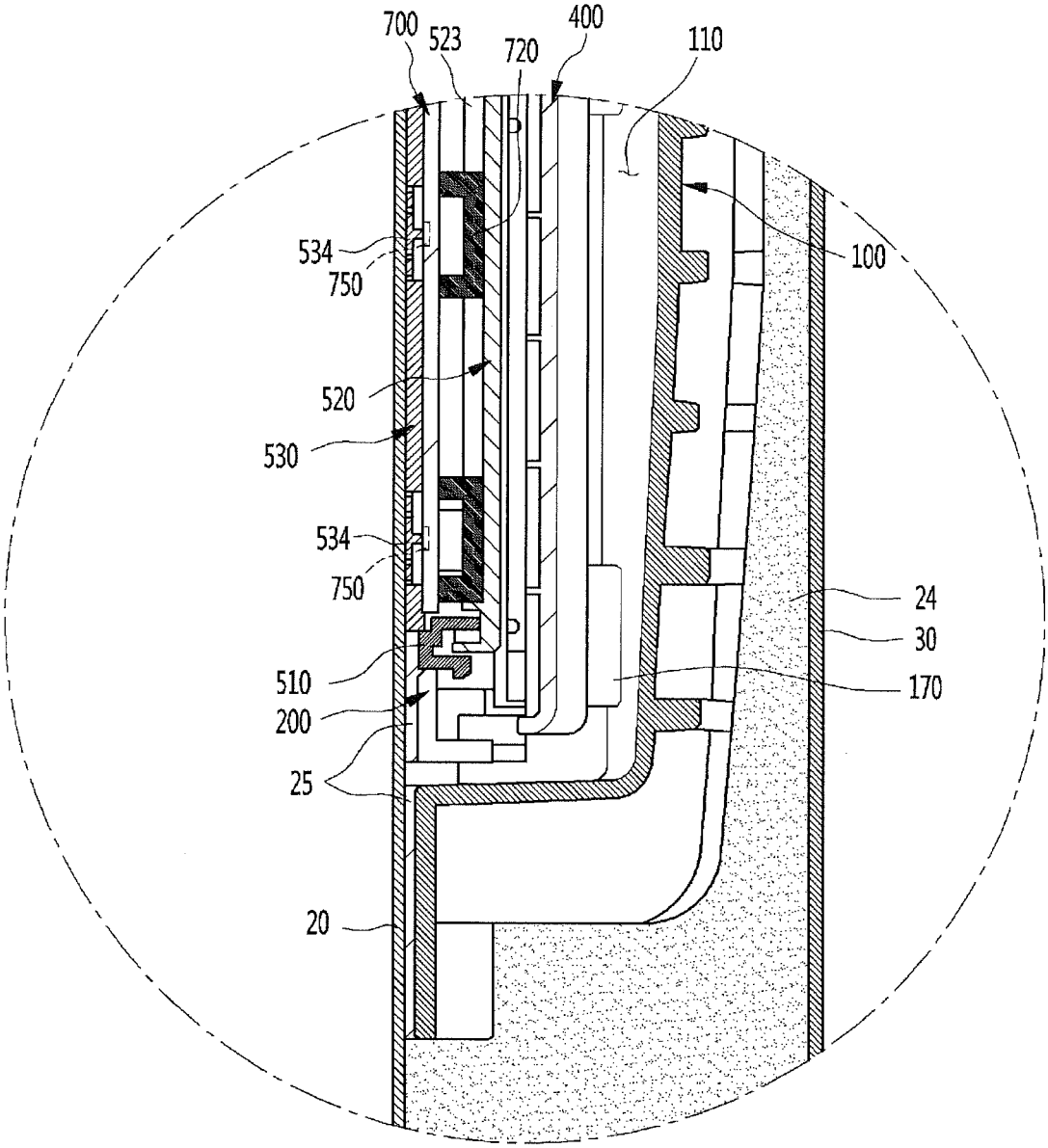
FIG. 25 is a cross-sectional view taken along line 25-25' of FIG. 2.
Figure 26:
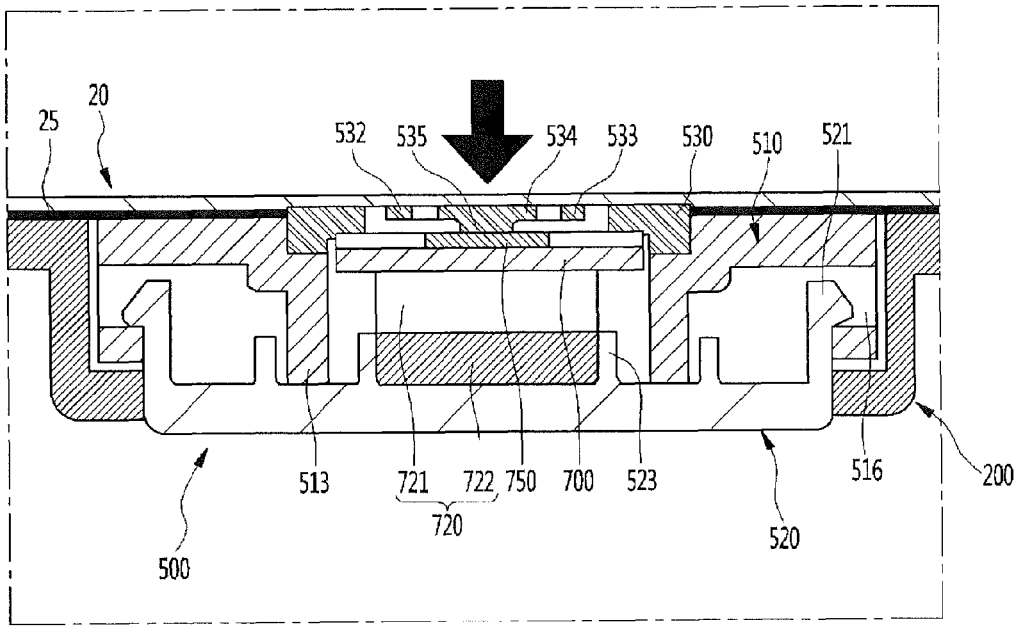
FIG. 26 is an enlarged view illustrating a portion C of FIG. 7.

Referring to FIGS. 25 and 26, the touch sensor assembly 500 is attached to the front panel 20 in a state in which the touch sensor assembly 500 is mounted on the display cover 200. As the adhesive members 25 is provided to the front surface of the display cover 200 and the front surface of the housing cover 510, the display cover 200 and the touch sensor assembly 500 may be adhered to the rear surface of the front panel 20.

The adhesive member 25 is not provided to the touch booster 530, and the touch booster 530 is simply pressed against the rear surface of the front panel 20. In other words, in a state in which the touch sensor assembly 500 is mounted on the display cover 200, when the touch sensor assembly 500 is attached to the rear surface of the front panel 20, the touch booster 530 is moved backward and the elastic member 720 is compressed. Thus, the sensor PCB 700 is pressed forward by a restoring force of the elastic member 720. As a result, the sensor PCB 700 is pressed against the touch booster 530.

The touch booster 530 may be moved forward or backward by touch pressure in a state in which the touch booster 530 is coupled to the housing cover 510.

In the above-described state, when a user touches the touch operation unit 12 of the front panel 20, a movement displacement of the front panel 20 is generated at a region on which the front panel 20 is touched. The movement displacement of the front panel 20 is immediately transmitted through the touch booster 530 to the sensor 750, and presses the sensor 750. As a result, a touch signal is generated from the sensor 750, a controller of the refrigerator senses a user's touch operation.

Here, as the touch booster 530 moves backward by a user's touch of the front panel 20, the elastic member 720 may be more compressed.

When a hand is detached from the touch operation unit 12, the sensor PCB 700 and the touch booster 530 move forward and return to a previous state by a restoring force of the elastic member 720, a restoring force of the elastic deformation portion of the touch booster 530, and a restoring force of the metal plate 751 of the sensor 750.

The elastic member 720 configured to press and support the sensor PCB 700 may be formed to have various shapes to provide uniform pressure to the sensor PCB 700 when the sensor housing is coupled thereto.

Figure 27:
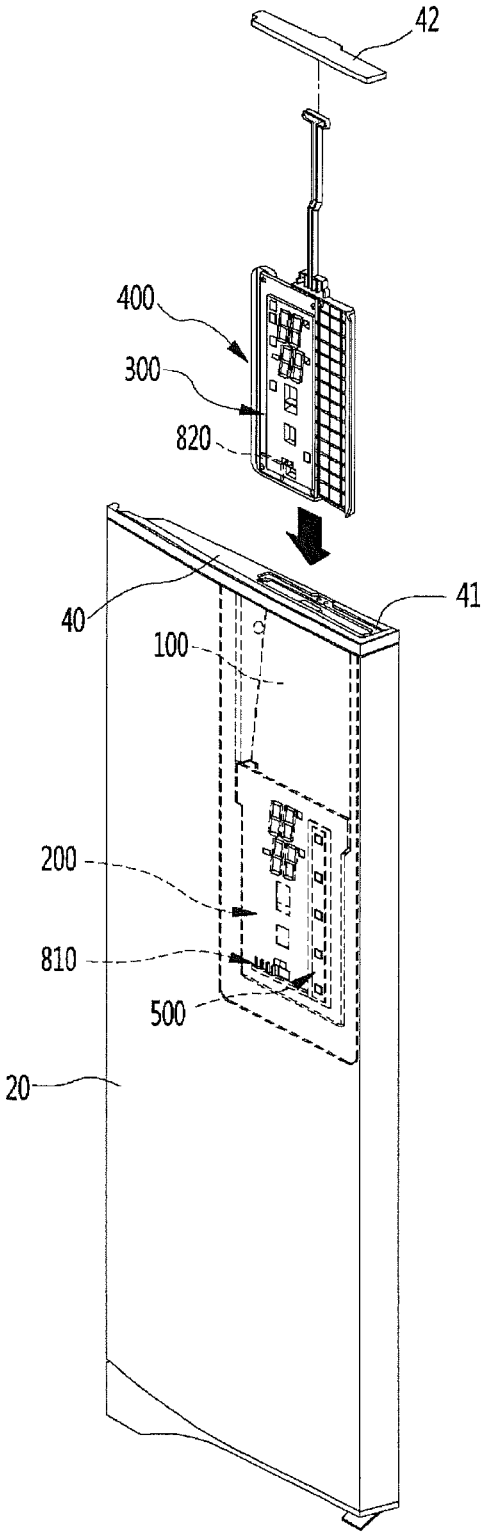
FIG. 27 is an exploded perspective view illustrating a state before the touch sensor assembly is coupled to the display assembly.
Figure 28:
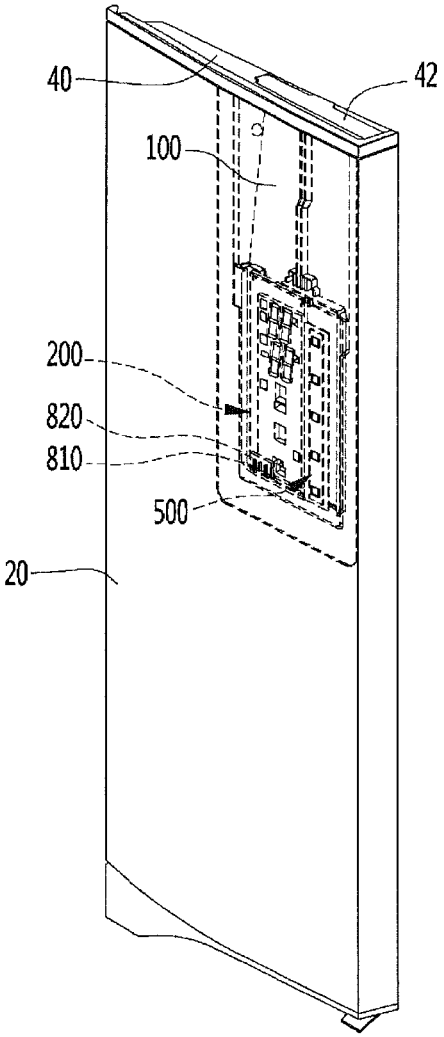
FIG. 28 is a perspective view illustrating a state after the touch sensor assembly is coupled to the display assembly.

Referring to FIGS. 27 and 28, the front panel 20 is formed of a plate-shaped stainless steel to manufacture the door 10. The plurality of first through holes 21 which constitute the display window 11 may be formed at the front panel 20 using an etching or a laser processing. The first through holes 21 may be filled with the sealing member 22, and the diffusive sheet 26 may be attached to the rear surface of the front panel 20 in which the first through holes 21 are formed (see FIG. 15). In addition, the touch operation unit 12 may be formed at the front panel 20 using an etching, a surface processing, or a printing.

When the front panel 20 is completely formed, the touch sensor assembly 500 is assembled.

In order to assemble the touch sensor assembly 500, the elastic member 720 is attached to the rear surface of the sensor PCB 700, and the spacer 730 is attached to the front surface thereof. In addition, the sensor 750 is positioned at the sensor support portion 713 formed at the sensor PCB 700, and the conductive foil 740 is adhered thereto. In addition, a cover member 770 which covers a rear end opening of the sensor support portion 713 and seals an inside of the sensor support portion 713 is adhered to the rear surface of the sensor PCB 700.

In order to adhere the spacer 730 and the conductive foil 740, the alignment rod is disposed at a predetermined position of the sensor PCB 700, and the spacer 730 is attached thereto, and here, the through hole 733 passes through the alignment rod of the spacer 730. Accordingly, the spacer 730 may be attached to a correct position on the top surface of the sensor PCB 700.

Here, as described above, as the spacer 730 is attached thereto in a direction toward which the bent hole 732 extends, bubbles generated while the spacer 730 is attached may be discharged through the bent hole 732.

When the spacer 730 is completely attached thereto, the conductive foil 740 is attached to a top surface of the spacer 730.

Like the spacer 730, the through hole 744 is attached thereto to pass through the alignment rod, the conductive foil 740 is attached to a correct position, and the conductive foil 740 and the spacer 730 are aligned accurately.

In addition, as the conductive foil 740 is gradually attached thereto from an end portion of one side in the direction toward which the bent hole 732 extends, and bubbles are not trapped in the conductive foil 740 and the spacer 730.

In a state in which the conductive foil 740 is attached to a correct position, an edge of an outside of the sensor 750 is correctly interposed between the inner guide line 742 and the outer guide line 743.

When the housing cover 510 and the housing body 520 are coupled, the elastic member 720 is compressed, the sensor PCB 700 is pressed, and as a result, the sensor PCB 700 is pressed against the touch booster 530. Here, the touch booster 530 is installed thereto to move forward or backward, and the front surface of the touch booster 530 protrudes more than the front surface of the housing cover 510.

The completely assembled touch sensor assembly 500 is seated on the accommodation portion 210 of the display cover 200, the housing coupling portion 511 is coupled to an edge of an upper side of the accommodation portion 210, and a state in which the touch sensor assembly 500 is fixed to the display cover 200 is maintained.

In the above-described state, the adhesive members 25 are attached to the front surfaces of the display cover 200 and the housing cover 510, and the display cover 200 and the touch sensor assembly 500 are simultaneously attached to the rear surface of the front panel 20 using the adhesive members 25.

When the display cover 200 is attached to the front panel 20, the frame 100 is fixed to the front panel 20 so that the display cover 200 is accommodated therein. In addition, the door liner 30 is coupled to the rear surface of the front panel, and the Deco members 40 are coupled to upper ends of the front panel 20 and the door liner 30. In the above-described state, a foam solution is foamed in the inside of the door 10, and the heat insulating material 24 is formed. The heat insulating material 24 is filled in an entire inner space of the door 10 except an inside of the frame 100, and stably fixes the frame 100.

In a state in which the heat insulating material 24 is completely formed in an inside of the door 10, the display assembly 300 is mounted on the display frame 400.

Specifically, in a state in which the display assembly 300 is mounted on the display frame 400, a worker inserts the display frame 400 through the insertion hole 41. In addition, the display frame 400 is completely inserted into the display cover 200 using the frame handle 420.

In addition, when the display frame 400 is inserted, the display assembly 300 is also moved downward with the display frame 400. In addition, the display connector 820 on the display PCB 310 faces the sensor connector 810, and the display connector 820 and the sensor connector 810 are electrically and structurally coupled to each other.

That is, the sensor connector 810 and the display connector 820 may be coupled to each other by only an insertion and mounting of the display assembly 300. In addition, since the sensor PCB 700 and the sensor controller 330 are electrically connected to each other, input signals generated by operations of the touch sensor 750 may be transmitted and processed by the sensor controller 330.

The sensor connector 810 and the display connector 820 are connected to each other after the heat insulating material 24 is completely formed. Accordingly, damage to the sensor controller 330 caused by static electricity generated while filling a foam solution and forming the heat insulating material may be prevented.

When the display frame 400 is completely inserted into the display cover 200, the display assembly 300 is completely pressed against the rear surface of the display cover 200. In addition, the first through hole 21, the second through hole 220, and the third through hole 321 are aligned and communicated with each other from front to back.

After the display frame 400 is completely inserted, the insertion hole cover 42 is mounted in the insertion hole 41, and the insertion hole 41 is closed. In addition, the upper end of the frame handle 420 is fixed by the insertion hole cover 42, and the door 10 is completely manufactured.

At this moment, the frame handle 420 is maintained in a fixed state by pushing the frame handle 420 downward while the insertion hole cover 42 is being mounted on the insertion hole 41. Accordingly, both of the sensor connector 810 and the display connector 820 may be maintained in firm fixed states, and may be prevented from being unexpectedly separated from each other.

What is claimed is:

1. A refrigerator door comprising:

a front panel that defines a front exterior of the refrigerator door;

a door liner coupled to the front panel and configured to define a rear exterior of the refrigerator door;

an insulating material configured to fill an insulation space defined between the front panel and the door liner;

a touch sensor assembly that is configured to press against a rear surface of the front panel, and that is configured to sense a touch input to the front panel;

a display assembly that is configured to display an operation state of the refrigerator on the front panel, and that is configured to be inserted into a space between the front panel and the door liner through the insulation space;

a sensor connector located at the touch sensor assembly; and a display connector located at the display assembly, and that is configured to connect electrically to the sensor connector based on the display assembly being inserted into the space between the front panel and the door liner at an installation position, wherein the touch sensor assembly comprises:

a touch sensor mounted to a sensor printed circuit board (PCB), wherein the sensor connector is configured to extend from the sensor PCB, wherein the sensor connector comprises:

a sensor extension portion that is configured to extend from the sensor PCB to a position at which the sensor connector is coupled to the display connector; and a terminal that is located at an end portion of the sensor extension portion, and that is configured to connect electrically with the display connector, wherein the display assembly comprises:

a light source including a light emitting diode (LED) mounted to a display PCB;

an LED controller configured to control the LED; and a sensor controller mounted on the display PCB and configured to process an input to the front panel detected by the touch sensor assembly, wherein the display PCB comprises:

a first side surface adjacent to the touch sensor assembly; and a second side surface opposite the first side surface, wherein the display connector and the sensor connector are provided at a lower end of the second side surface.

2. The refrigerator door of claim 1, wherein the sensor extension portion includes a part of the sensor PCB.

3. The refrigerator door of claim 1, wherein the display connector is provided at a lower side of the display PCB.

4. The refrigerator door of claim 1, wherein the front panel is a metallic front panel.

5. A refrigerator door comprising:

a front panel that defines a front exterior of the refrigerator door;

a door liner coupled to the front panel and configured to define a rear exterior of the refrigerator door;

an insulating material configured to fill an insulation space defined between the front panel and the door liner;

a touch sensor assembly that is configured to press against a rear surface of the front panel, and that is configured to sense a touch input to the front panel;

a display assembly that is configured to display an operation state of the refrigerator on the front panel, and that is configured to be inserted into a space between the front panel and the door liner through the insulation space;

a frame that is configured to press against the rear surface of the front panel and that is configured to define an accommodation space to house the touch sensor assembly and the display assembly;

a deco member with an inner side provided with an insertion hole into which the display assembly is configured to be inserted, and that is configured to cover an upper end of the insulation space; and an insertion hole cover configured to cover the insertion hole;

a display cover configured to press against the rear surface of the front panel in the accommodation space, wherein the touch sensor assembly is mounted on the display cover;

a guide rail that is located on the display cover and that is configured to guide an insertion of the display assembly;

a sensor connector located at the touch sensor assembly;

a display connector located at the display assembly, and that is configured to connect electrically to the sensor connector based on the display assembly being inserted into the space between the front panel and the door liner at an installation position;

a display frame that is configured to be inserted into the display cover based on the display assembly being mounted on a front surface of the refrigerator door; and a frame handle that is configured to extend from an upper end of the display frame, wherein the display frame is configured to be inserted along the guide rail and an upper end of the frame handle is restricted by the insertion hole cover based on the sensor connector being coupled to the display connector.

6. A refrigerator comprising:

a storage compartment; and a refrigerator door configured to open and close at least a portion of the storage compartment, the refrigerator door comprising:

a front panel that defines a front exterior of the refrigerator door;

a door liner coupled to the front panel and configured to define a rear exterior of the refrigerator door;

an insulating material configured to fill an insulation space defined between the front panel and the door liner;

a touch sensor assembly that is configured to press against a rear surface of the front panel, and that is configured to sense a touch input to the front panel;

a display assembly that is configured to display an operation state of the refrigerator on the front panel, and that is configured to be inserted into a space between the front panel and the door liner through the insulation space;

a sensor connector located at the touch sensor assembly; and a display connector located at the display assembly, and that is configured to connect electrically to the sensor connector based on the display assembly being inserted into the space between the front panel and the door liner at an installation position, wherein the touch sensor assembly comprises:

a touch sensor mounted to a sensor printed circuit board (PCB), wherein the sensor connector is configured to extend from the sensor PCB, wherein the sensor connector comprises:

a sensor extension portion that is configured to extend from the sensor PCB to a position at which the sensor connector is coupled to the display connector; and a terminal that is located at an end portion of the sensor extension portion, and that is configured to connect electrically with the display connector, wherein the display assembly comprises:

a light source including a light emitting diode (LED) mounted to a display PCB;

an LED controller configured to control the LED; and a sensor controller mounted on the display PCB and configured to process an input to the front panel detected by the touch sensor assembly, wherein the display PCB comprises:

a first side surface adjacent to the touch sensor assembly; and a second side surface opposite the first side surface, wherein the display connector and the sensor connector are provided at a lower end of the second side surface.

7. The refrigerator of claim 6, wherein the sensor extension portion includes a part of the sensor PCB.

8. The refrigerator of claim 6, wherein the display connector is provided at a lower side of the display PCB.

9. The refrigerator of claim 6, wherein the front panel is a metallic front panel.

* * * * *